US010262666B2

(12) United States Patent
Fuchs et al.

(10) Patent No.: US 10,262,666 B2
(45) Date of Patent: Apr. 16, 2019

(54) PROCESSOR, METHOD AND COMPUTER PROGRAM FOR PROCESSING AN AUDIO SIGNAL USING TRUNCATED ANALYSIS OR SYNTHESIS WINDOW OVERLAP PORTIONS

(71) Applicant: Fraunhofer-Gesellschaft zur Foerderung der angewandten Forschung e.V., Munich (DE)

(72) Inventors: Guillaume Fuchs, Bubenreuth (DE); Markus Multrus, Nuremberg (DE); Matthias Neusinger, Rohr (DE); Andreas Niedermeier, Munich (DE); Markus Schnell, Nuremberg (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 15/417,236

(22) Filed: Jan. 27, 2017

(65) Prior Publication Data

US 2017/0140768 A1 May 18, 2017

Related U.S. Application Data

(63) Continuation of application No. PCT/EP2015/066997, filed on Jul. 24, 2015.

(30) Foreign Application Priority Data

Jul. 28, 2014 (EP) ..... 14178774

(51) Int. Cl.
*G10L 19/022* (2013.01)
*G10L 19/025* (2013.01)
*G10L 21/028* (2013.01)

(52) U.S. Cl.
CPC ..... *G10L 19/025* (2013.01); *G10L 21/028* (2013.01)

(58) Field of Classification Search
CPC combination set(s) only.
See application file for complete search history.

(56) References Cited

U.S. PATENT DOCUMENTS 5,394,473 A * 2/1995 Davidson ..... G10L 19/0212 375/240
7,987,089 B2 7/2011 Krishnan et al.
(Continued)

FOREIGN PATENT DOCUMENTS

EP 2800094 A1 11/2014
EP 2619758 B1 8/2015
(Continued)

OTHER PUBLICATIONS

"ISO/IEC 14496-3 International Standard", Information Technology—Coding of audio-visual objects—Part 3: Audio, Fourth edition, Aug. 2009, 1416 pages.
(Continued)

*Primary Examiner* — Abul K Azad
(74) *Attorney, Agent, or Firm* — Perkins Coie LLP; Michael A. Glenn

(57) ABSTRACT

A processor for processing an audio signal has: an analyzer for deriving a window control signal from the audio signal indicating a change from a first asymmetric window to a second window, or indicating a change from a third window to a fourth asymmetric window, wherein the second window is shorter than the first window, or wherein the third window is shorter than the fourth window; a window constructor for constructing the second window using a first overlap portion of the first asymmetric window, wherein the window constructor is configured to determine a first overlap portion of the second window using a truncated first overlap portion of
(Continued)

(ENCODER)

the first asymmetric window, or wherein the window constructor is configured to calculate a second overlap portion of the third window using a truncated second overlap portion of the fourth asymmetric window; and a windower for applying the first and second windows or the third and fourth windows to obtain windowed audio signal portions.

18 Claims, 21 Drawing Sheets

(56) References Cited

U.S. PATENT DOCUMENTS

| | | | | |
|---|---|---|---|---|
| 8,484,038 | B2 | 7/2013 | Bessette et al. | |
| 8,762,159 | B2 | 6/2014 | Geiger et al. | |
| 9,384,748 | B2 * | 7/2016 | Beack | G10L 19/022 |
| 2008/0027719 | A1 | 1/2008 | Kirshnan et al. | |
| 2012/0022881 | A1 | 1/2012 | Geiger et al. | |
| 2012/0271644 | A1 | 10/2012 | Bessette et al. | |
| 2013/0268264 | A1 * | 10/2013 | Taleb | G10L 19/0212 704/203 |
| 2014/0142930 | A1 | 5/2014 | Faure et al. | |
| 2014/0142957 | A1 | 5/2014 | Sung et al. | |
| 2016/0055852 | A1 | 2/2016 | Daniel et al. | |

FOREIGN PATENT DOCUMENTS

| | | | |
|---|---|---|---|
| EP | 2947654 | A1 | 11/2015 |
| EP | 2980791 | A1 | 2/2016 |
| JP | H06508731 | A | 9/1994 |
| JP | 2010507111 | A | 3/2010 |
| JP | 2014130359 | A | 7/2014 |
| JP | 2014524048 | A | 9/2014 |
| RU | 2520402 | C2 | 6/2014 |
| RU | 2647634 | C2 | 3/2018 |
| TW | 200816718 | A | 4/2008 |
| TW | 201032218 | A | 9/2010 |
| TW | 201129970 | A | 9/2011 |
| TW | 201419265 | A | 5/2014 |
| WO | 9222137 | A1 | 12/1992 |
| WO | 2010040522 | A2 | 4/2010 |
| WO | 2011124473 | A1 | 10/2011 |
| WO | 2014056705 | A1 | 4/2014 |
| WO | 2014128194 | A1 | 8/2014 |

OTHER PUBLICATIONS

Helmrich, Christian R. et al., "Improved Low-Delay MDCT-Based Coding of Both Stationary and Transient Audio Signals", IEEE International Conference on Acoustic, Speech and Signal Processing (ICASSP), 2014, 5 pages.

Valin, Jim et al., "Definition of the Opus Audio Codec", Internet Engineering Task Force (IETF), RFC 6716, Sep. 2012, 326 pages.

Lecomte, Jeremie et al., "Efficient Cross-Fade Windows for Transitions between LPC-Based and Non-LPC Based Audio Coding", Lecomte Jeremie et al: "Efficient Cross-Fade Windows for Transitions between LPC-Based and Non-LPC Based Audio Coding" AES Convention 126; May 2009, AES, 60 East 42nd Street, Room 2520 New York 10165-2520, USA, May 1, 2009, XP040508994, the whole document, May 7, 2009, 1-9.

* cited by examiner (ENCODER)

(DECODER)

Case A:
- input is audio signal; audio signal analysis
- 1st and 2nd windows are analysis windows
- windowed signal is encoder-side processed Case B:
- input is windowed audio signal; bitstream analysis
- 3rd and 4th windows are synthesis windows
- windowed signal is subjected to overlap-add for synthesis

PROCESSOR, METHOD AND COMPUTER PROGRAM FOR PROCESSING AN AUDIO SIGNAL USING TRUNCATED ANALYSIS OR SYNTHESIS WINDOW OVERLAP PORTIONS

CROSS-REFERENCE TO RELATED APPLICATIONS

This application is a continuation of copending International Application No. PCT/EP2015/066997, filed Jul. 24, 2015, which is incorporated herein by reference in its entirety, and additionally claims priority from European Application No. 14178774.7, filed Jul. 28, 2014, which is also incorporated herein by reference in its entirety.

BACKGROUND OF THE INVENTION

The present invention is related to audio processing and particularly, to audio processing with overlapping windows for an analysis-side or synthesis-side of an audio signal processing chain.

Most contemporary frequency-domain audio coders based on overlapping transforms like the MDCT employ some kind of transform size switching to adapt time and frequency resolution to the current signal properties. Different approaches have been developed to handle the switching between the available transform sizes and their corresponding window shapes. Some approaches insert a transition window between frames encoded using different transform lengths, e.g. MPEG-4 (HE-)AAC [1]. The disadvantage of the transition windows is the need for an increased encoder look-ahead, making it unsuitable for low-delay applications. Others employ a fixed low window overlap for all transform sizes to avoid the need for transitions windows, e.g. CELT [2]. However, the low overlap reduces frequency separation, which degrades coding efficiency for tonal signals. An improved instant switching approach employing different transform and overlap lengths for symmetric overlaps is given in [3]. [6] shows an example for instant switching between different transform lengths using low-overlap sine windows.

On the other hand low-delay audio coders often employ asymmetric MDCT windows, as they exhibit a good compromise between delay and frequency separation. On encoder-side a shortened overlap with the subsequent frame is used to reduce the look-ahead delay, while a long overlap with the previous frame is used to improve frequency separation. On decoder-side a mirrored version of the encoder window is used. Asymmetric analysis and synthesis windowing is depicted in FIGS. 8*a* to 8*c*.

SUMMARY

According to an embodiment, a processor for processing an audio signal may have: an analyzer for deriving a window control signal from the audio signal indicating a change from a first asymmetric window to a second window or for indicating a change from a third window to a fourth asymmetric window, wherein the second window is shorter than the first window, or wherein the third window is shorter than the fourth window; a window constructor for constructing the second window using a first overlap portion of the first asymmetric window, wherein the window constructor is configured to determine a first overlap portion of the second window using a truncated first overlap portion of the first asymmetric window, or wherein the window constructor is configured to calculate a second overlap portion of the third window using a truncated second overlap portion of the fourth asymmetric window; and a windower for applying the first and second windows or the third and fourth windows to obtain windowed audio signal portions.

According to another embodiment, a method of processing an audio signal may have the steps of: deriving a window control signal from the audio signal indicating a change from a first asymmetric window to a second window or for indicating a change from a third window to a fourth asymmetric window, wherein the second window is shorter than the first window, or wherein the third window is shorter than the fourth window; constructing the second window using a first overlap portion of the first asymmetric window, wherein the window constructor is configured to determine a first overlap portion of the second window using a truncated first overlap portion of the first asymmetric window, or wherein the window constructor is configured to calculate a second overlap portion of the third window using a truncated second overlap portion of the fourth asymmetric window; and applying the first and second windows or the third and fourth windows to obtain windowed audio signal portions.

Another embodiment may have a non-transitory digital storage medium having stored thereon a computer program for performing a method of processing an audio signal, having the steps of: deriving a window control signal from the audio signal indicating a change from a first asymmetric window to a second window or for indicating a change from a third window to a fourth asymmetric window, wherein the second window is shorter than the first window, or wherein the third window is shorter than the fourth window; constructing the second window using a first overlap portion of the first asymmetric window, wherein the window constructor is configured to determine a first overlap portion of the second window using a truncated first overlap portion of the first asymmetric window, or wherein the window constructor is configured to calculate a second overlap portion of the third window using a truncated second overlap portion of the fourth asymmetric window; and applying the first and second windows or the third and fourth windows to obtain windowed audio signal portions, when said computer program is run by a computer.

The present invention is based on the finding that asymmetric transform windows are useful for achieving good coding efficiency for stationary signals at a reduced delay. On the other hand, in order to have a flexible transform size switching strategy, analysis or synthesis windows for a transition from one block size to a different block size allow the use of truncated overlap portions of asymmetric windows as window edges or as a basis for window edges without disturbing the perfect reconstruction property.

Hence, truncated portions of an asymmetric window such as the long overlap portion of the asymmetric window can be used within the transition window. However, in order to comply with the necessitated length of the transition window, this overlap portion or asymmetric window edge or flank is truncated to a length allowable within the transition window constraints. This, however, does not violate the perfect reconstruction property. Hence, this truncation of window overlap portions of asymmetric windows allows short and instant switching transition windows without any penalty from the perfect reconstruction side.

In further embodiments, it is of advantage to not use the truncated overlap portion directly, but to smooth or fade-in or fade-out the discontinuity incurred by truncating the asymmetric window overlap portion under consideration.

Further embodiments rely on a highly memory-saving implementation, due to the fact that only a minimum amount of window edges or window flanks are stored in the memory and even for fading-in or fading-out, a certain window edge is used. These memory-efficient implementations additionally construct descending window edges from a stored ascending window edge or vice versa by means of logic or arithmetic operations, so that only a single edge, such as either an ascending or a descending edge has to be stored and the other one can be derived on the fly.

An embodiment comprises a processor or a method for processing an audio signal. The processor has an analyzer for deriving a window control signal from the audio signal indicating a change from a first asymmetric window to a second window in an analysis-processing of the audio signal. Alternatively or additionally, the window control signal indicates a change from a third window to a fourth asymmetric window in the case of, for example, a synthesis signal processing. Particularly, for the analysis-side, the second window is shorter than the first window or, on the synthesis-side, the third window is shorter than the fourth window.

The processor additionally comprises a window constructor for constructing the second window or the third window using a first overlap portion of the first asymmetric window. Particularly, the window constructor is configured to determine the first overlap portion of the second window using a truncated first overlap portion of the first asymmetric window. Alternatively, or additionally, the window constructor is configured to calculate a second overlap portion of the third window using a second overlap portion of the fourth asymmetric window.

Finally, the processor has a windower for applying the first and second windows, particularly for an analysis processing or for applying the third and fourth windows in the case of a synthesis processing to obtain windowed audio signal portions.

As known, an analysis windowing takes place at the very beginning of an audio encoder, where a stream of time-discrete and time-subsequent audio signal samples are windowed by window sequences and, for example, a switch from a long window to a short window is performed when the analyzer actually detects a transient in the audio signal. Then, subsequent to the windowing, a conversion from the time domain to the frequency domain is performed and, in embodiments, this conversion is performed using the modified discrete cosine transform (MDCT). The MDCT uses a folding operation and a subsequent DCT IV transform in order to generate, from a set of 2N time domain samples, a set of N frequency domain samples, and these frequency domain values are then further processed.

On the synthesis-side, the analyzer does not perform an actual signal analysis of the audio signal, but the analyzer derives the window control signal from a side information to the encoded audio signal indicating a certain window sequence determined by an encoder-side analyzer and transmitted to the decoder-side processor implementation. The synthesis windowing is performed at the very end of the decoder-side processing, i.e., subsequent to a frequency-time conversion and unfolding operation which generates, from a set of N spectral values a set of 2N time-domain values, which are then windowed and, subsequent to the synthesis windowing using the inventive truncated window edges, an overlap-add as necessitated is performed. Advantageously, a 50% overlap is applied for the positioning of the analysis windows and for the actual overlap-adding subsequent to synthesis windowing using the synthesis windows.

Hence, advantages of the present invention are that the present invention relies on asymmetric transform windows, which have good coding efficiency for stationary signals at a reduced delay. On the other hand, the present invention allows a flexible transform size switching strategy for an efficient coding of transient signals, which does not increase the total coder delay. Hence, the present invention relies on a combination of asymmetric windows for long transforms and a flexible transform/overlap-length switching concept for symmetric overlap ranges of short windows. The short windows can be fully symmetric having the same symmetric overlap on both sides, or can be asymmetric having a first symmetric overlap with a preceding window and a second different symmetric overlap with a subsequent window.

The present invention is specifically advantageous in that, by the usage of the truncated overlap portion from the asymmetric long window, any coder delay or necessitated coder look-ahead is not increased due to the fact that any transition from windows with different block sizes does not require the insertion of any additional long transition windows.

BRIEF DESCRIPTION OF THE DRAWINGS

Embodiments of the present invention are subsequently discussed with respect to the accompanying drawings, in which.

DETAILED DESCRIPTION OF THE INVENTION

Figure 1A:
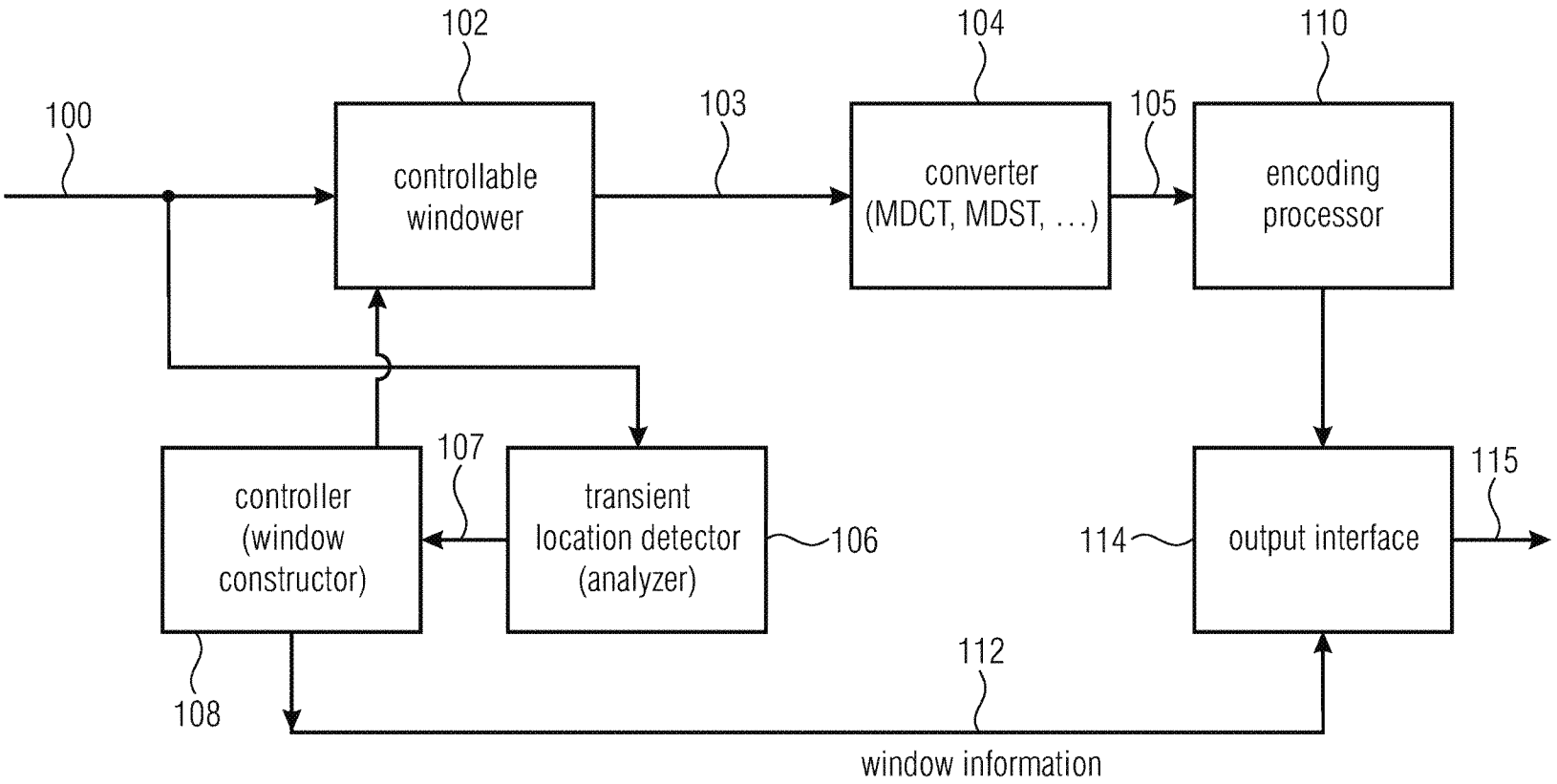
FIG. 1*a* illustrates an aspect for encoding in the context of truncated overlap portions.

Embodiments relate to concepts for instantly switching from a long MDCT transform using an asymmetric window to a shorter transform with symmetrically overlapping windows, without the need for inserting an intermediate frame.

When constructing the window shape for the first frame employing a shorter transform length, two restrictions are an issue:

- The left overlapping part of the window needs to match the shape of the previous asymmetric window in a way so that perfect or near-perfect reconstruction is achieved.
- The length of the overlapping parts is constrained due to the shorter transform length.

The left overlapping part of the long asymmetric window would satisfy the first condition, but it is too long for shorter transforms, which usually have half or less the size of the long transform. Therefore a shorter window shape needs to be chosen.

It is assumed here that the asymmetric analysis and synthesis windows are symmetric to each other, i.e. the synthesis window is a mirrored version of the analysis window. In this case the window w has to satisfy the following equation for perfect reconstruction:

$$w_n w_{2L-1-n} + w_{L+n} w_{L-1-n} = 1,\ n = 0 \ldots L-1,$$

where L represents the transform length and n the sample index.

For delay reduction the right side overlap of the asymmetric long analysis window has been shortened, which means all of the rightmost window samples have a value of zero. From the equation above it can be seen that if a window sample $w_n$ has a value of zero, an arbitrary value can be chosen for the symmetric sample $w_{2L-1-n}$. If the rightmost m samples of the window are zero, the leftmost m samples may therefore be replaced by zeroes as well without losing perfect reconstruction, i.e. the left overlapping part can be truncated down to the length of the right overlapping part.

If the truncated overlap length is short enough, so that sufficient overlap length remains for the right part of the first short transform window, this gives a solution for the first short transform window shape, satisfying both of the above conditions. The left end of the asymmetric window's overlapping part is truncated and combined with the symmetric overlap used for subsequent short windows. An example of the resulting window shape is depicted in FIG. 10*c*.

Using a truncated version of the existing long window overlap avoids the need to design a completely new window shape for the transition. It also reduces ROM/RAM demand for hardware on which the algorithm is implemented, as no additional window table is required for the transition.

For synthesis windowing on decoder-side a symmetric approach is used. The asymmetric synthesis window has the long overlap on the right side. A truncated version of the right overlapping part is therefore used for the right window part of the last short transform before switching back to long transforms with asymmetric windows, as depicted in FIG. 13*d*.

As shown above the use of a truncated version of the long window allows for perfect reconstruction of the time-domain signal if the spectral data is not modified between analysis and synthesis transform. However, in an audio coder quantization is applied to the spectral data. In the synthesis transform the resulting quantization noise is shaped by the synthesis window. As the truncation of the long window introduces a step in the window shape, discontinuities can occur in the quantization noise of the output signal. These discontinuities can become audible as click-like artifacts.

In order to avoid such artifacts, a fade-out can be applied to the end of the truncated window to smooth the transition to zero. The fade-out can be done in several different ways, e.g. it could be linear, sine or cosine shaped. The length of the fade-out should be chosen large enough so that no audible artifacts occur. The maximum length available for the fade-out without losing perfect reconstruction is determined by the short transform length and the length of the window overlaps. In some cases the available length might be zero or too small to suppress artifacts. For such cases it can be beneficial to extend the fade-out length and accept small reconstruction errors, as these are often less disturbing than discontinuities in the quantization noise. Carefully tuning the fade-out length allows to trade reconstruction errors against quantization error discontinuities, in order to achieve best audio quality.

Figure 10A:
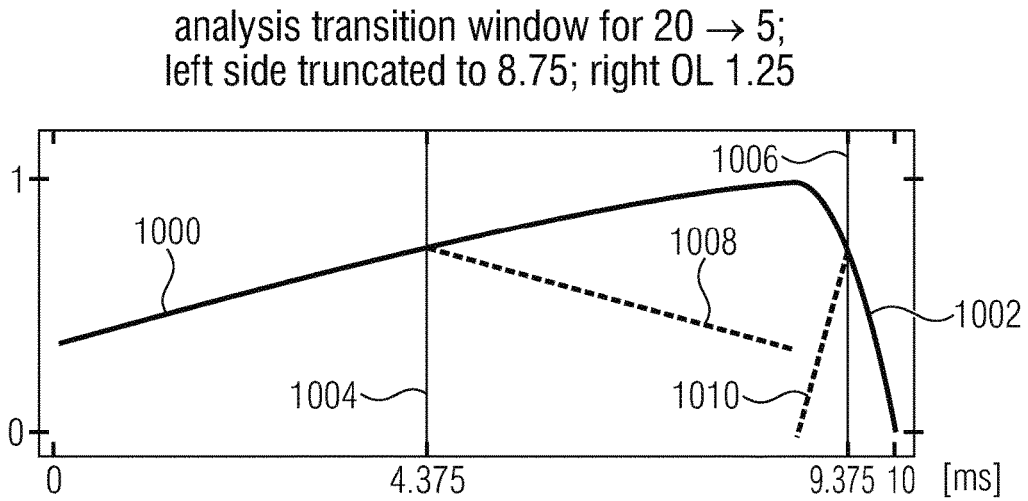
FIG. 10*a* illustrates an analysis transition window such as the second window with a truncated first overlap portion.
Figure 10B:
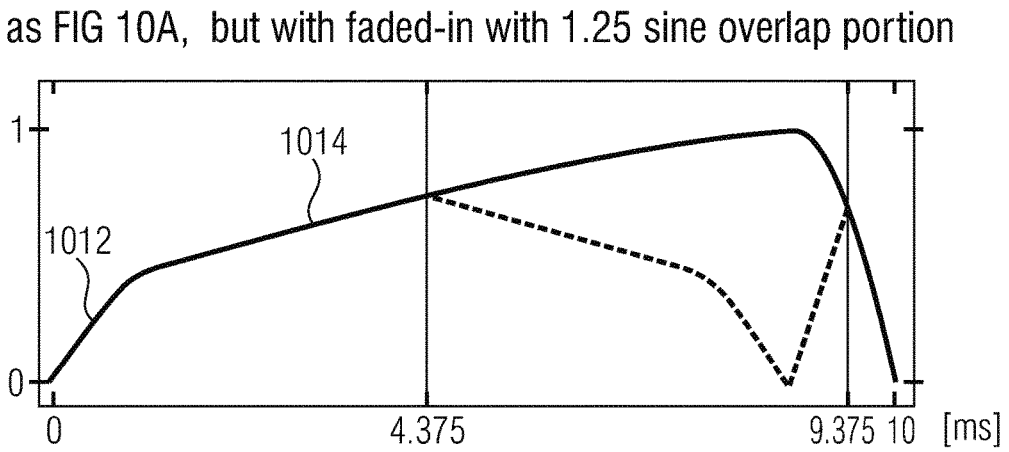
FIG. 10*b* illustrates a second window with a truncated and faded-in first overlap portion.
Figure 10C:
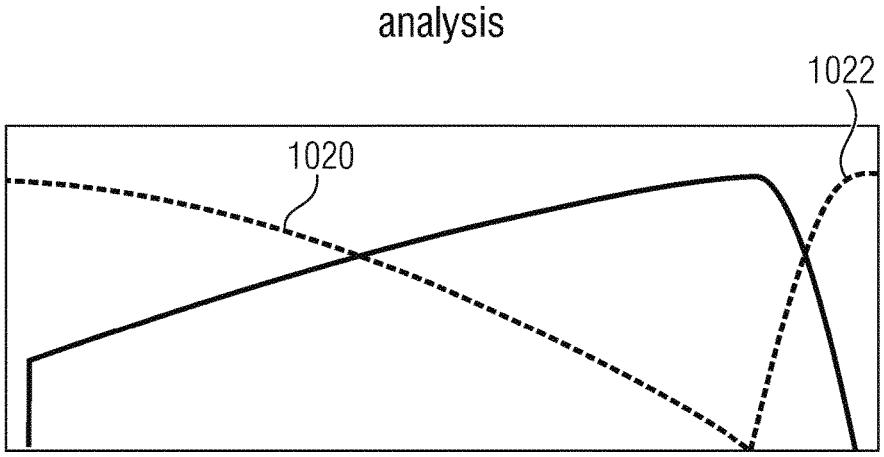
FIG. 10*c* illustrates the second window of FIG. 10*a* in the context of the corresponding overlapping portions of the preceding and subsequent windows.
Figure 10D:
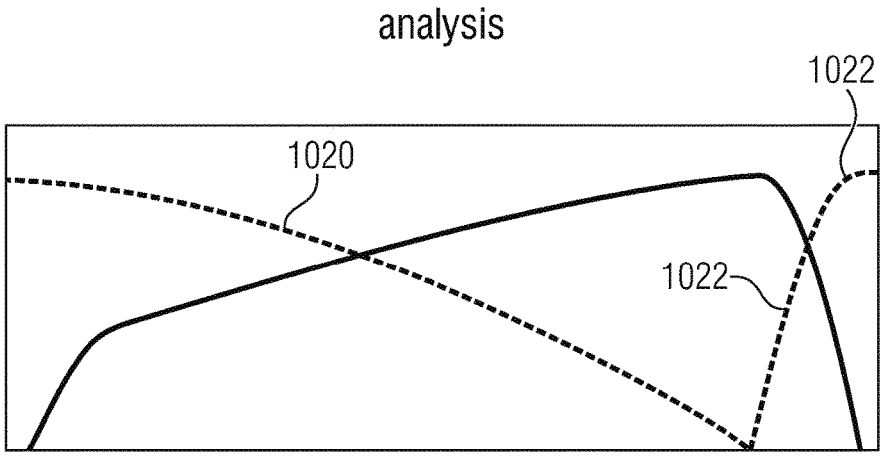
FIG. 10*d* illustrates the situation of FIG. 10*c*, but with a faded-in first overlap portion.

FIG. 10*d* depicts an example for a truncated overlap with a short fade-out by multiplying the truncated end of the window with a sine function.

Figure 2:
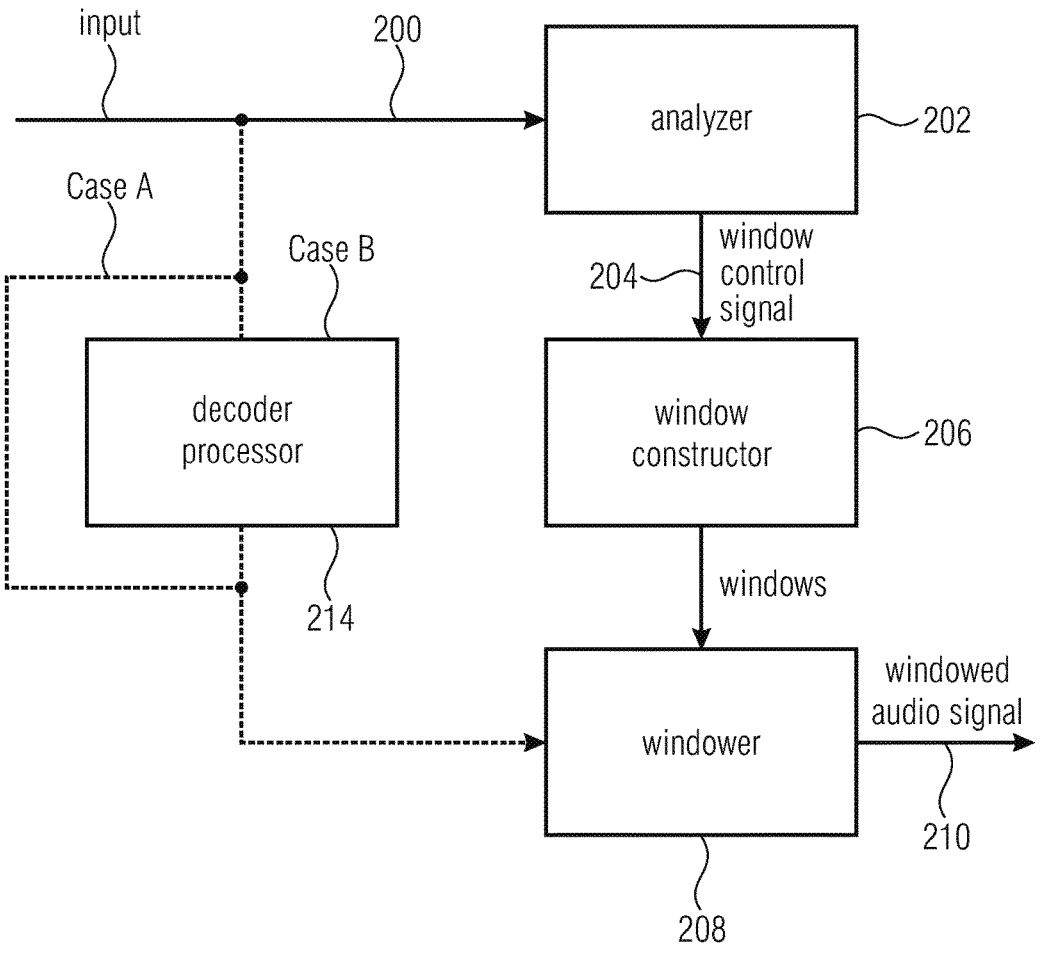
FIG. 2 illustrates an embodiment of the present invention for the analysis-side (case A) or the synthesis-side (case B)

Subsequently, FIG. 2 is discussed in order to describe a processor for processing an audio signal in accordance with embodiments of the present invention. The audio signal is provided at an input 200 into an analyzer 202. The analyzer is configured for deriving a window control signal 204 from the audio signal at the input 200, where the window control signal indicates a change from a first asymmetric window to a second window as, for example, illustrated by the first window 1400 or 1500 in FIG. 14*a* or FIG. 15*a*, where the second window, in this embodiment, is window 1402 in FIG. 14*a* or 1502 in FIG. 15*a*. The window control signal 204 again, alternatively, and with respect to an operation at a synthesis-side exemplarily indicates a change from a third window such as 1450 in FIG. 14*b* or 1550 in FIG. 5*b* to a third window such as 1452 in FIG. 14*b* or 1552 in FIG. 15*b*. As illustrated, the second window such as 1402 is shorter than the first window 1400 or the third window such as 1450 or 1550 is shorter than the fourth window such as 1452 or 1552.

The processor further comprises a window constructor 206 for constructing the second window using a first overlap portion of a first asymmetric window, wherein this window constructor is configured to determine a first overlap portion of the second window using a truncated first overlap portion of the first asymmetric window for the synthesis-side, i.e., case B in FIG. 2. The window constructor is configured to calculate a second overlap portion of the third window such as 1502 or 1550 using a truncated second overlap portion of the first window, i.e., the asymmetric window.

These windows, such as the second window on the analysis-side or the third window on the synthesis-side and, of course, the preceding and/or subsequent windows are transmitted from the window constructor 206 to a windower 208. The windower 208 applies the first and second windows or the third and fourth windows to an audio signal in order to obtain the signal portions at an output 210.

Case A is related to the analysis-side. Here, the input is an audio signal and the actual analyzer 202 performs an actual audio signal analysis such as a transient analysis etc. The first and second windows are analysis windows and the windowed signal is encoder-side processed as will be discussed later on with respect to FIG. 1A.

Hence, a decoder processor 214 illustrated in FIG. 2 is bypassed or actually not present in case A.

In case B, i.e., when the inventive processing is applied on a synthesis-side, the input is the encoded audio signal such as a bitstream having audio signal information and side information, and the analyzer 202 performs a bitstream analysis or a bitstream or encoded signal parsing in order to retrieve, from the encoded audio signal, a window control signal indicating the window sequence applied by the encoder, from which the window sequence to be applied by the decoder can be derived.

Figure 1B:
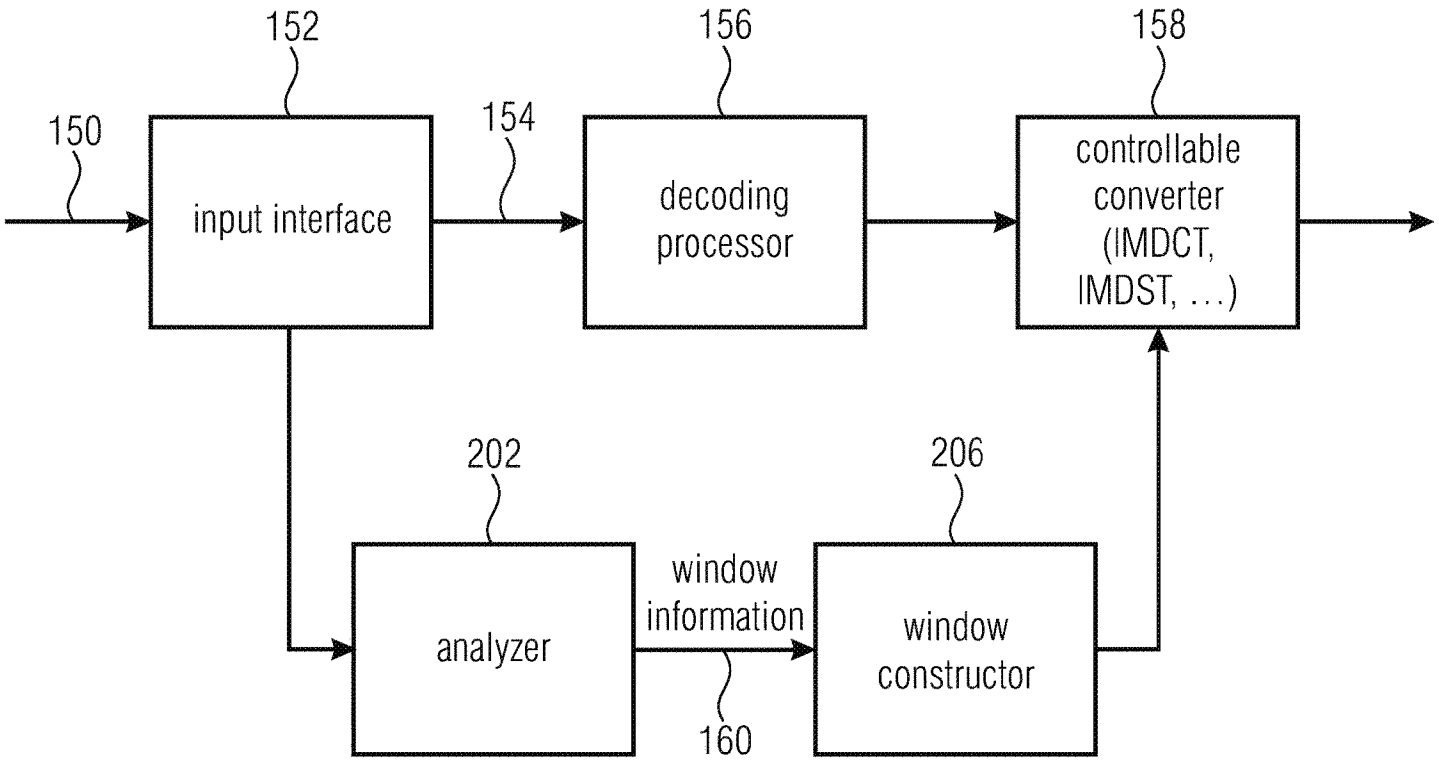
FIG. 1*b* illustrates an apparatus for decoding in the context of using truncated overlap portions.

Then, the third and fourth windows are synthesis windows and the windowed signal is subjected to an overlap-add processing for the purpose of an audio signal synthesis as illustrated in FIG. 1B or 10.

FIG. 1*a* illustrates an apparatus for encoding an audio signal 100. The apparatus for encoding an audio signal comprises a controllable windower 102 for windowing the audio signal 100 to provide a sequence of blocks of windowed samples at 103. The encoder furthermore comprises a converter 104 for converting the sequence of blocks of windowed samples 103 into a spectral representation comprising a sequence of frames of spectral values indicated at 105. Furthermore, a transient location detector 106 is provided. The detector is configured for identifying a location of a transient within a transient look-ahead region of a frame. Furthermore, a controller 108 for controlling the controllable windower is configured for applying a specific window having a specified overlap length to the audio signal 100 in response to an identified location of the transient illustrated at 107. Furthermore, the controller 108 is, in an embodiment, configured to provide window information 112 not only to the controllable windower 102, but also to an output interface 114 which provides, at its output, the encoded audio signal 115. The spectral representation comprising the sequence of frames of spectral values 105 is input in an encoding processor 110, which can perform any kind of encoding operation such as a prediction operation, a temporal noise shaping operation, a quantizing operation advantageously with respect to a psychoacoustic model or at least with respect to psycho-acoustic principles or may comprise a redundancy-reducing encoding operation such as a Huffman encoding operation or an arithmetic encoding operation. The output of the encoding processor 110 is then forwarded to the output interface 114 and the output interface 114 then finally provides the encoded audio signal having associated, to each encoded frame, a certain window information 112.

The controller 108 is configured to select the specific window from a group of at least three windows. The group comprises a first window having a first overlap length, a second window having a second overlap length, and a third window having a third overlap length or no overlap. The first overlap length is greater than the second overlap length and the second overlap length is greater than a zero overlap. The specific window is selected, by the controllable windower 102 based on the transient location such that one of two time-adjacent overlapping windows has first window coefficients at the location of the transient and the other of the two time-adjacent overlapping windows has second window coefficients at the location of the transient and the second window coefficients are at least nine times greater than the first coefficients. This makes sure that the transient is substantially suppressed by the first window having the first (small) coefficients and the transient is quite unaffected by the second window having the second window coefficients. Advantageously, the first window coefficients are equal to 1 within a tolerance of plus/minus 5%, such as between 0.95 and 1.05, and the second window coefficients are advantageously equal to 0 or at least smaller than 0.05. The window coefficients can be negative as well and in this case, the relations and the quantities of the window coefficients are related to the absolute magnitude.

Furthermore, alternatively or in addition, the controller 108 comprises the functionalities of the window constructor 206 as discussed in the context of FIG. 2 and will be discussed later on. Furthermore, the transient location detector 106 can be implemented and can have the functionalities of the analyzer 202 of FIG. 2 for case A, i.e., for the application of the windows on the analysis-side.

Furthermore, blocks 104 and 110 illustrate processing to be performed by the windowed audio signal 210, which corresponds to the windowed audio signal 103 in FIG. 1A. Furthermore, the window constructor 206, although not specifically indicated in FIG. 2 provides the window information 112 of FIG. 1A to the output interface 114, which can then be regained from the encoded signal by the analyzer 202 operating on the decoder-side, i.e., for case B.

As known in the art of MDCT processing, generally, processing using an aliasing-introducing transform, this aliasing-introducing transform can be separated into a folding-in step and a subsequent transform step using a certain non-aliasing introducing transform. In an example, sections are folded in other sections and the result of the folding operation is then transformed into the spectral domain using a transform such as a DCT transform. In the case of an MDCT, a DCT IV transform is applied.

Subsequently, this is exemplified by reference to the MDCT, but other aliasing-introducing transforms can be processed in a similar and analogous manner. As a lapped transform, the MDCT is a bit unusual compared to other Fourier-related transforms in that it has half as many outputs as inputs (instead of the same number). In particular, it is a linear function F: $R^{2N} \rightarrow R^{N}$ (where R denotes the set of real numbers). The 2N real numbers x0, . . . x2N−1 are transformed into the N real numbers X0, . . . , XN−1 according to the formula:

$$X_k = \sum_{n=0}^{2N-1} x_n \cos\left[\frac{\pi}{N}\left(n + \frac{1}{2} + \frac{N}{2}\right)\left(k + \frac{1}{2}\right)\right]$$

(The normalization coefficient in front of this transform, here unity, is an arbitrary convention and differs between treatments. Only the product of the normalizations of the MDCT and the IMDCT, below, is constrained.)

The inverse MDCT is known as the IMDCT. Because there are different numbers of inputs and outputs, at first glance it might seem that the MDCT should not be invertible. However, perfect invertibility is achieved by adding the overlapped IMDCTs of time-adjacent overlapping blocks, causing the errors to cancel and the original data to be retrieved; this technique is known as time-domain aliasing cancellation (TDAC).

The IMDCT transforms N real numbers X0, . . . , XN−1 into 2N real numbers y0, . . . , y2N−1 according to the formula:

$$y_n = \frac{1}{N}\sum_{k=0}^{N-1} X_k \cos\left[\frac{\pi}{N}\left(n+\frac{1}{2}+\frac{N}{2}\right)\left(k+\frac{1}{2}\right)\right]$$

(Like for the DCT-IV, an orthogonal transform, the inverse has the same form as the forward transform.)

In the case of a windowed MDCT with the usual window normalization (see below), the normalization coefficient in front of the IMDCT should be multiplied by 2 (i.e., becoming 2/N).

In typical signal-compression applications, the transform properties are further improved by using a window function wn (n=0, . . . , 2N−1) that is multiplied with xn and yn in the MDCT and IMDCT formulas, above, in order to avoid discontinuities at the n=0 and 2N boundaries by making the function go smoothly to zero at those points. (That is, we window the data before the MDCT and after the IMDCT.) In principle, x and y could have different window functions, and the window function could also change from one block to the next (especially for the case where data blocks of different sizes are combined), but for simplicity we consider the common case of identical window functions for equal-sized blocks.

The transform remains invertible (that is, TDAC works), for a symmetric window wn=w2N−1−n, as long as w satisfies the Princen-Bradley condition:

$$w_n^2+w_{n+N}^2=1$$

various window functions are used. A window that produces a form known as a modulated lapped transform is given by $$w_n = \sin\left[\frac{\pi}{2N}\left(n+\frac{1}{2}\right)\right]$$

and is used for MP3 and MPEG-2 AAC, and $$w_n = \sin\left(\frac{\pi}{2}\sin^2\left[\frac{\pi}{2N}\left(n+\frac{1}{2}\right)\right]\right)$$

for Vorbis. AC-3 uses a Kaiser-Bessel derived (KBD) window, and MPEG-4 AAC can also use a KBD window.

Note that windows applied to the MDCT are different from windows used for some other types of signal analysis, since they fulfill the Princen-Bradley condition. One of the reasons for this difference is that MDCT windows are applied twice, for both the MDCT (analysis) and the IMDCT (synthesis).

As can be seen by inspection of the definitions, for even N the MDCT is essentially equivalent to a DCT-IV, where the input is shifted by N/2 and two N-blocks of data are transformed at once. By examining this equivalence more carefully, important properties like TDAC can be easily derived.

In order to define the precise relationship to the DCT-IV, it is to be kept in mind that the DCT-IV corresponds to alternating even/odd boundary conditions: even at its left boundary (around n=−½), odd at its right boundary (around n=N−½), and so on (instead of periodic boundaries as for a DFT). This follows from the identities:

$$\cos\left[\frac{\pi}{N}\left(-n-1+\frac{1}{2}\right)\left(k+\frac{1}{2}\right)\right] = \cos\left[\frac{\pi}{N}\left(n+\frac{1}{2}\right)\left(k+\frac{1}{2}\right)\right] \text{ and}$$

$$\cos\left[\frac{\pi}{N}\left(2N-n-1+\frac{1}{2}\right)\left(k+\frac{1}{2}\right)\right] = -\cos\left[\frac{\pi}{N}\left(n+\frac{1}{2}\right)\left(k+\frac{1}{2}\right)\right].$$

Thus, if its inputs are an array x of length N, we can imagine extending this array to (x, −xR, −x, xR, . . . ) and so on, where xR denotes x in reverse order.

Consider an MDCT with 2N inputs and N outputs, where we divide the inputs into four blocks (a, b, c, d) each of size N/2. If we shift these to the right by N/2 (from the +N/2 term in the MDCT definition), then (b, c, d) extend past the end of the N DCT-IV inputs, so we "fold" them back according to the boundary conditions described above.

Thus, the MDCT of 2N inputs (a, b, c, d) is exactly equivalent to a DCT-IV of the N inputs: (−cR−d, a−bR), where R denotes reversal as above.

(In this way, any algorithm to compute the DCT-IV can be trivially applied to the MDCT.) Similarly, the IMDCT formula above is precisely ½ of the DCT-IV (which is its own inverse), where the output is extended (via the boundary conditions) to a length 2N and shifted back to the left by N/2. The inverse DCT-IV would simply give back the inputs (−cR−d, a−bR) from above. When this is extended via the boundary conditions and shifted, one obtains:

$$\mathrm{IMDCT}(\mathrm{MDCT}(a,b,c,d))=(a-bR,b-aR,c+dR,d+cR)/2.$$

Half of the IMDCT outputs are thus redundant, as b−aR=−(a−bR)R, and likewise for the last two terms. If we group the input into bigger blocks A,B of size N, where A=(a, b) and B=(c, d), we can write this result in a simpler way:

$$\mathrm{IMDCT}(\mathrm{MDCT}(A,B))=(A-AR,B+BR)/2$$

One can now understand how TDAC works. Suppose that one computes the MDCT of the time-adjacent, 50% overlapped, 2N block (B, C). The IMDCT will then yield, analogous to the above: (B−BR, C+CR)/2. When this is added with the previous IMDCT result in the overlapping half, the reversed terms cancel and one obtains simply B, recovering the original data.

The origin of the term "time-domain aliasing cancellation" is now clear. The use of input data that extend beyond the boundaries of the logical DCT-IV causes the data to be aliased in the same way that frequencies beyond the Nyquist frequency are aliased to lower frequencies, except that this aliasing occurs in the time domain instead of the frequency domain: we cannot distinguish the contributions of a and of bR to the MDCT of (a, b, c, d), or equivalently, to the result of IMDCT(MDCT(a, b, c, d))=(a−bR, b−aR, c+dR, d+cR)/2. The combinations c−dR and so on, have precisely the right signs for the combinations to cancel when they are added.

For odd N (which are rarely used in practice), N/2 is not an integer so the MDCT is not simply a shift permutation of a DCT-IV. In this case, the additional shift by half a sample means that the MDCT/IMDCT becomes equivalent to the DCT-III/II, and the analysis is analogous to the above.

We have seen above that the MDCT of 2N inputs (a, b, c, d) is equivalent to a DCT-IV of the N inputs (−cR−d, a−bR). The DCT-IV is designed for the case where the function at the right boundary is odd, and therefore the values near the right boundary are close to 0. If the input signal is smooth, this is the case: the rightmost components of a and bR are consecutive in the input sequence (a, b, c, d), and therefore their difference is small. Let us look at the middle of the interval: if we rewrite the above expression as (−cR−d, a−bR)=(−d, a)−(b,c)R, the second term, (b,c)R, gives a smooth transition in the middle. However, in the first term, (−d, a), there is a potential discontinuity where the right end of −d meets the left end of a. This is the reason for using a window function that reduces the components near the boundaries of the input sequence (a, b, c, d) towards 0.

Above, the TDAC property was proved for the ordinary MDCT, showing that adding IMDCTs of time-adjacent blocks in their overlapping half recovers the original data. The derivation of this inverse property for the windowed MDCT is only slightly more complicated.

Consider two overlapping consecutive sets of 2N inputs (A,B) and (B,C), for blocks A,B,C of size N. Recall from above that when (A,B) and (B,C) are MDCTed, IMDCTed, and added in their overlapping half, we obtain $(B+B_R)/2+(B-B_R)/2=B$, the original data.

Now we suppose that we multiply both the MDCT inputs and the IMDCT outputs by a window function of length 2N. As above, we assume a symmetric window function, which is therefore of the form $(W, W_R)$ where W is a length-N vector and R denotes reversal as before. Then the Princen-Bradley condition can be written as $W+W_R^2=(1, 1, \ldots)$, with the squares and additions performed elementwise.

Therefore, instead of MDCTing (A,B), one now MDCTs $(WA, W_RB)$ with all multiplications performed elementwise. When this is IMDCTed and multiplied again (elementwise) by the window function, the last-N half becomes:

$$W_R\cdot(W_RB+(W_RB)_R)=W_R\cdot(W_RB+WB_R)=W_R^2B+WW_RB_R$$

(Note that we no longer have the multiplication by ½, because the IMDCT normalization differs by a factor of 2 in the windowed case.)

Similarly, the windowed MDCT and IMDCT of (B,C) yields, in its first-N half:

$$W\cdot(WB-W_RB_R)=W^2B-WW_RB_R$$

When one adds these two halves together, one recovers the original data.

The above MDCT discussion describes identical analysis/synthesis windows. For asymmetric windows analysis/synthesis windows are different, but advantageously symmetric to each other; in that case the Princen-Bradley condition changes to the more general equation:

$$w_nw_{2L-1-n}+w_{L+n}W_{L-1-n}=1,\ n=0\ldots L-1$$

FIG. 1*b* illustrates a decoder implementation having an input 150 for an encoded signal, an input interface 152 providing an audio signal 154 on the one hand which is in encoded form and providing side information to the analyzer 202 on the other hand. The analyzer 202 extracts window information 160 from the encoded signal 150 and provides this window information to the window constructor 206. Furthermore, the encoded audio signal 154 is input into a decoder or a decoding processor 156, which corresponds to the decoder processor 214 in FIG. 2 and the window constructor 206 provides the windows to the controllable converter 158 which is configured for performing an IMDCT or an IMDST or any other transform being inverse to an aliasing-introducing forward transform.

Figure 1C:
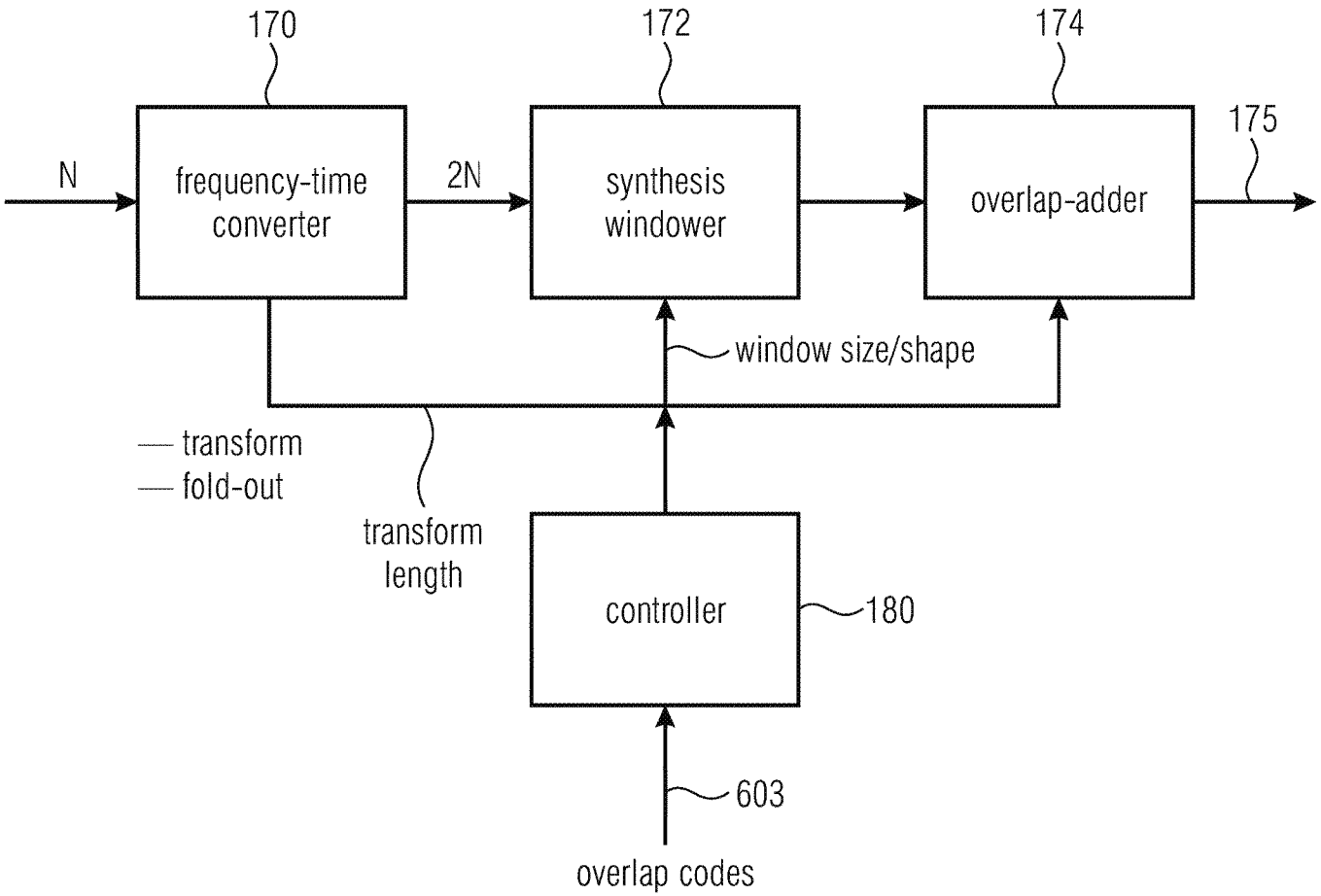
FIG. 1*c* illustrates a more detailed illustration of the synthesis-side.

FIG. 1*c* illustrates a decoder-side implementation of the controllable converter 158. In particular, the controllable converter 158 comprises a frequency-time converter 170, a subsequently connected synthesis windower 172 and a final overlap-adder 174. Specifically, the frequency-time converter performs the transform such as a DCT-IV transform and a subsequent fold-out operation so that the output of the frequency-time converter 170 has, for a first or long window, 2N samples while the input into the frequency-time converter was, exemplarily, N spectral values. On the other hand, when the input into the frequency-time converter are N/8 spectral values, then the output is N/4 time domain values for an MDCT operation, exemplarily.

Then, the output of the frequency-time converter 170 is input into a synthesis windower which applies the synthesis window which is advantageously symmetric to the encoder-side window. Thus, each sample is, before an overlap-add is performed, windowed by two windows so that the resulting "total windowing" is the product of the analysis window coefficients and the synthesis window coefficients so that the Princen-Bradley condition as discussed before is fulfilled.

Finally, the overlap-adder 174 performs the corresponding correct overlap-add in order to finally obtain the decoded audio signal at output 175.

Figure 1D:
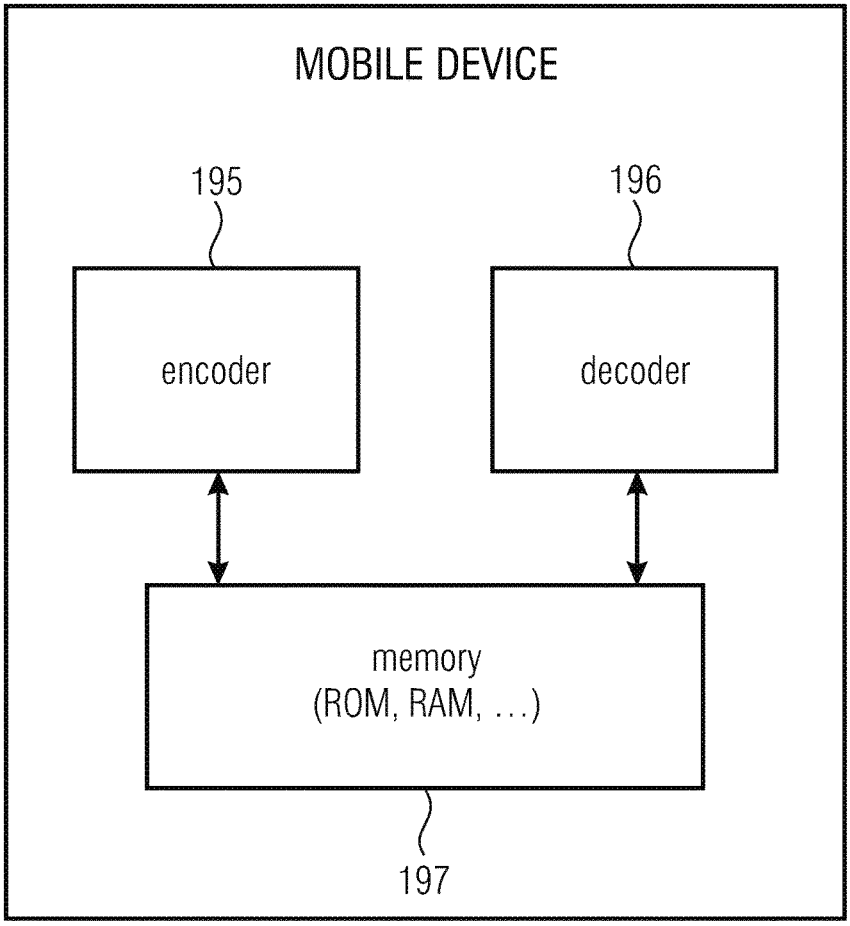
FIG. 1*d* illustrates an implementation of a mobile device having an encoder, a decoder and a memory.

FIG. 1*d* illustrates a further embodiment of the present invention implemented with a mobile device, where the mobile device comprises, on the one hand, an encoder 195 and on the other hand a decoder 196. Furthermore, in accordance with an embodiment of the present invention, both the encoder 105 and the decoder 106 retrieve the same window information from only a single memory 197, since the windows used in the encoder 195 and the windows used in the decoder 196 are symmetric to each other. Thus, the decoder has a read-only memory 197 or a random access memory or generally any memory 197 in which only a single set of window sequences or windows is stored for usage both in the encoder and in the decoder. This is advantageous due to the fact that the different window coefficients for the different windows do not have to be stored two times, with one set for the encoder and one set for the decoder. Instead, due to the fact that in accordance with the present invention identical windows and window sequences are used in the encoder and the decoder, only a single set of window coefficients has to be stored. Hence, the memory usage of the inventive mobile device illustrated in FIG. 1*d* is substantially reduced with respect to a different concept in which the encoder and the decoder have different windows or in which certain post-processing with processing other than windowing operations is performed.

Subsequently, an advantageous window is discussed with respect to FIG. 8*a*. It has a first overlap portion 800, a second overlap portion 802, a further portion 804 with high values and a further portion 806 with low values. The high values of portion 804 are 1.0 values or are at least greater than 0.95, and the low values in the low portion 806 are equal to 0.0 and are advantageously lower than 0.1. In the embodiment, the length of the asymmetric analysis window is 40 ms and this results in a block size of 20 ms due to the fact that a 50% overlap-add may be used. However, other overlap ratios, etc. can be used as well.

Figure 8A:
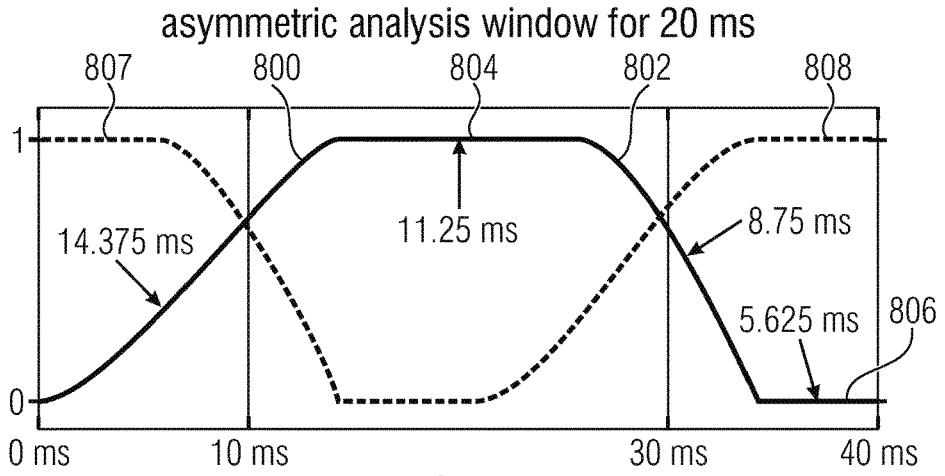
FIG. 8*a* illustrates an asymmetric analysis window.

In this specific implementation, the first overlap portion 800 is greater than the second overlap portion 802 which allows a low delay implementation and, additionally, in the context of the fact that the low portion 806 precedes the second overlap portion, the asymmetric analysis window illustrated in FIG. 8*a* allows a low delay filtering due to the zero portion and the short second overlap portion 802 and additionally has a quite good separation due to the long first overlap portion 800. This long overlap, however, does not cause any additional delay due to the fact that the long overlap portion is at the first half of the asymmetric analysis window. In the specific embodiment, the first overlap portion 800 is equal to 14.375 ms, the second non-overlapping part or high part is equal to 11.25 ms, the third part or the second overlap portion 802 is equal to 8.75 ms and the final fourth part or low part is equal to 5.625 ms.

Figure 8B:
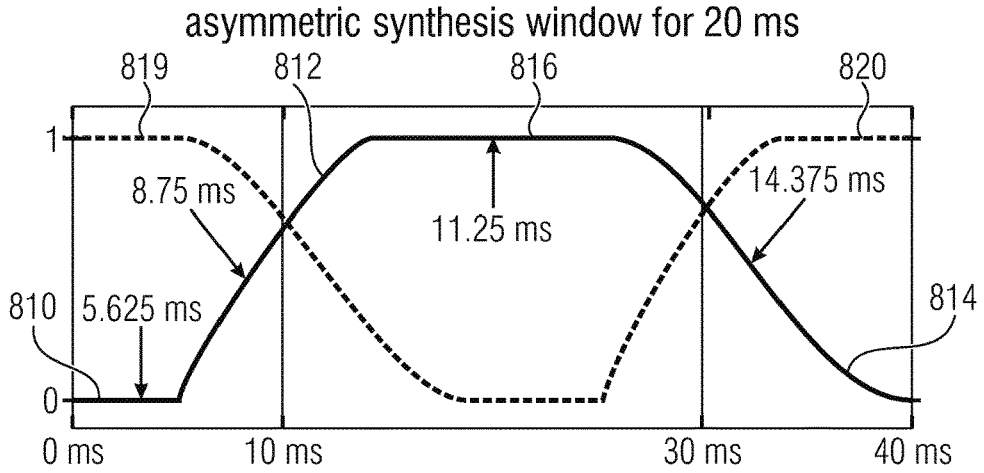
FIG. 8*b* illustrates an asymmetric synthesis window.

FIG. 8*b* illustrates a corresponding asymmetric synthesis window which now has, as the first part 810 the zero or low part, which then has the first overlap portion 812, the second overlap portion 814 and the constant or high part 816 indicated between the first overlap portion 812 and the second overlap portion 814.

The exemplary length of the corresponding parts is indicated but it is generally of advantage that the first overlap portion 812 is shorter than the second overlap portion 814 and it is furthermore of advantage that the length of the constant or high part 816 is between the length of the first overlap portion and the second overlap portion and it is furthermore of advantage that the length of the first part 810 or the zero part is lower than the length of the first overlap portion 812.

As illustrated in FIG. 8*a*, it is of advantage that the length of the first overlap portion 800 is higher than the length of the second overlap portion 802, and the length of the high part 804 is between the length of the second overlap portion 802 and the first overlap portion 800 and the length of the fourth part 806 is lower than the length of the second overlap portion 802.

FIG. 8*a* and FIG. 8*b* furthermore illustrate the overlap with a preceding asymmetric analysis window 807 and with a subsequent analysis window 808 for the case, when only long blocks are used and any switching is not indicated by the window control signal 204 of FIG. 2.

Analogously, FIG. 8*b* illustrates a corresponding synthesis sequence with a preceding synthesis window 819 and a subsequent synthesis window 820.

Figure 8C:
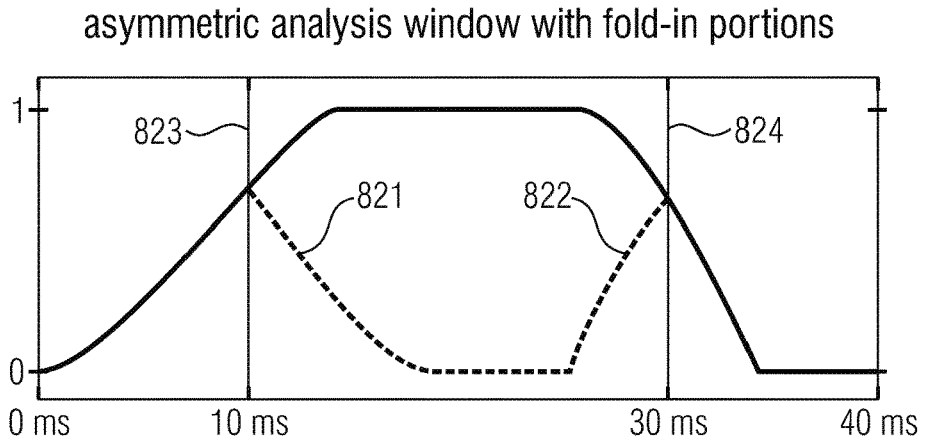
FIG. 8*c* illustrates an asymmetric analysis window with folding-in portions.

Furthermore, FIG. 8*c* illustrates the same analysis window of FIG. 8*a*, but now with folded portions 821, 822, which are folded in the fold-in operation on the encoder-side or which are "de-folded" in the foldout on the decoder-side. These foldings 821, 822 can be considered to take place along folding lines 823 and 824 and these lines are also illustrated in FIG. 8*a*, 8*b* and it appears that the folding lines do not directly coincide with the crossing points of the windows in FIGS. 8*a* and 8*b*. This is due to the asymmetric characteristic of the analysis window in FIG. 8*a* or the synthesis window in FIG. 8*b*.

Figure 9A:
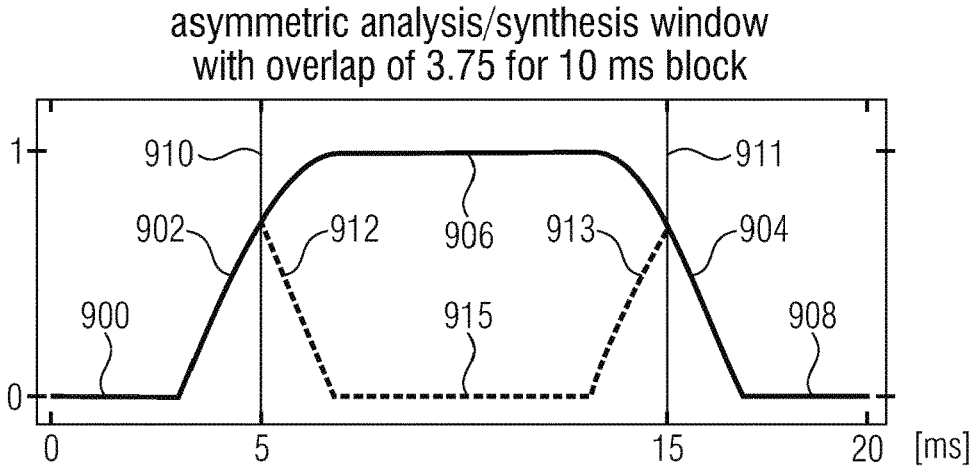
FIG. 9*a* illustrates a symmetric analysis/synthesis window.

FIG. 9*a* illustrates a symmetric analysis/synthesis window with an overlap of 3.75 ms for a 10 ms block length. The symmetric analysis window comprises a first low or zero part 900, a first overlap part 902, a second overlap part 904, a high or constant part 906 and a further low or zero part 908. Furthermore, FIG. 9*a* illustrates folding lines 910, 911, where the folding operation necessitated by the aliasing introducing transform such as the MDCT or MDST is performed. Particularly, a folding-in operation is performed on the encoder-side processing and a folding-out processing is performed on the decoder-side audio processing. Hence, the lines 912, 913 illustrate the folding portions, which have the decreasing part and a subsequent zero part corresponding to the parts 900 with respect to the left side and 908 with respect to the right side. Hence, marker 915 illustrates the border between the left fold-in portion 912 and the right fold-in portion 913.

In this context, it is outlined that FIG. 9*a* illustrates a truly symmetric analysis or synthesis window, since the left overlap portion and the right overlap portion are symmetric to each other, i.e., have the same overlap length of, in this embodiment, 3.75 ms. Generally, it is of advantage to have the zero portions 900, 908 smaller than the overlap portions 902, 904 and, consequently, the high portion 906 has two times the length of a single zero portion, when both zero portions 900, 908 have the same length.

Figure 9B:
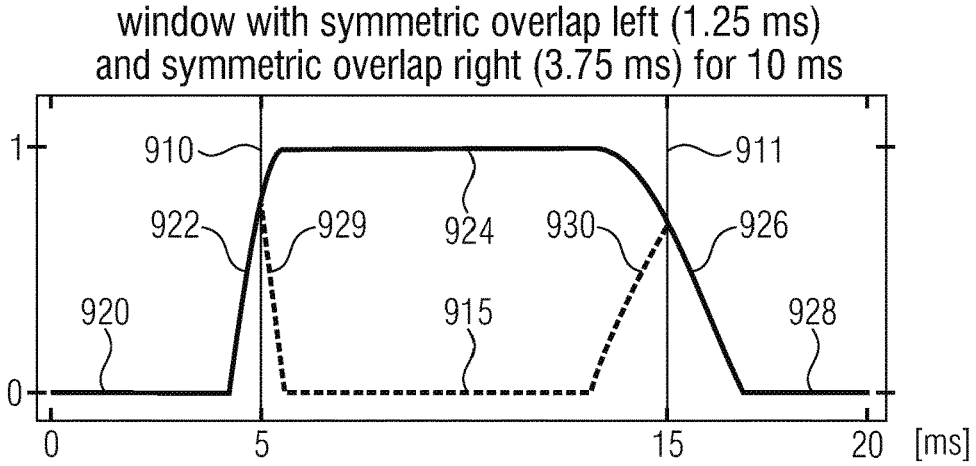
FIG. 9*b* illustrates a further analysis/synthesis window with symmetric, but different overlap portions.

FIG. 9*b* illustrates a window with a symmetric overlap which, however, is different on the left side and on the right side. In particular, this window has, in analogy to FIG. 9*a*, a zero part 920, a first overlap portion 922, a constant or high part 924, a second overlap portion 926 and a second zero or low part 928. Again, folding lines 910 and 911 are indicated and, again, the marker 915 indicates the border between the left fold-in part 929 and the right fold-in part 930. As illustrated, the left overlap portion 922 is for a short overlap such as 1.25 ms and the right overlap portion 926 is for a longer overlap such as 3.75 ms. Hence, this window is a transition window from windowing with a short overlap window to a higher overlap window but both such windows are widows with symmetric overlaps.

Figure 9C:
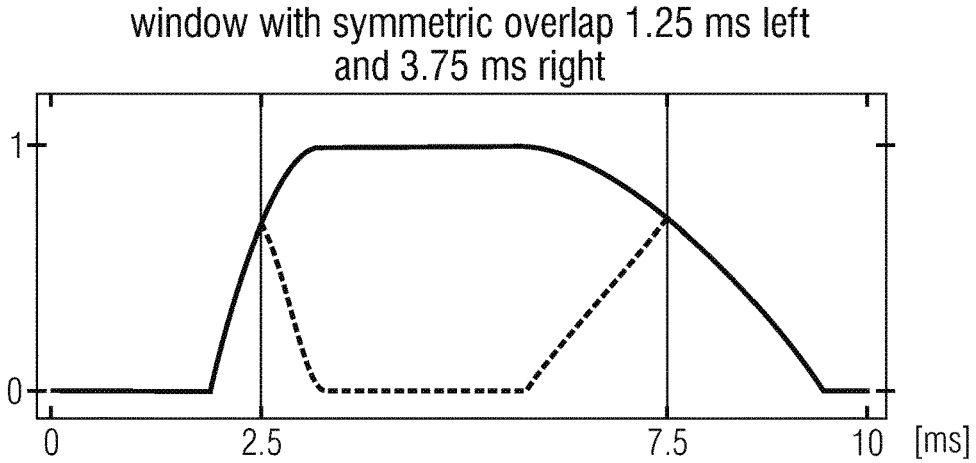
FIG. 9*c* illustrates a further window with symmetric overlap portions having different lengths.

FIG. 9*c* illustrates a further window but with a block size of 5 ms corresponding to a time duration of 10 ms as indicated. This window is analogous to FIG. 9*b* but with substantially different time lengths and the window in FIG. 9, therefore, has a shorter duration but once again has a sequence of a zero part, a left overlap portion with a short overlap, a high part, a subsequent second overlap portion and a final zero part. Furthermore, folding lines and fold-in portions etc., are again indicated in FIG. 9*c*.

Generally, most of the window figures from FIGS. 8*a* to 15*b* have indicated folding lines such as 910 and 911 of FIG. 9*a* and additionally have the folded outer window portions such as 912 and 913 in FIG. 9*a*.

Furthermore, it is outlined that the corresponding transformation length corresponds to the distance between the folding points. For example, when FIG. 9*a* is considered, it becomes clear that the transformation length corresponds to 10 ms which has the difference between 15 ms and 5 ms. Hence, the transform length corresponds to the notation of a "block" in FIG. 9*a* and the other figures. However, on the other hand, the actually windowed time portion is two times the transform or block length such as 20 ms in the FIG. 9*a* embodiment.

Correspondingly, the window in FIG. 9*c* has a transform length of 5 ms which corresponds to a length of the window time portion of 10 ms as illustrated in FIG. 9*c*.

In the asymmetric case illustrated in FIG. 8*a*, the transform length or block size is again the distance between the folding lines such as 823 and 824 and is, therefore, 20 ms and the length of the window time portion is 40 ms.

Necessitated for perfect reconstruction is to maintain the folding line or folding point when the long overlap portion or window edge of the asymmetric window such as 800 or 814 (for the synthesis side) is truncated.

Figure 4:
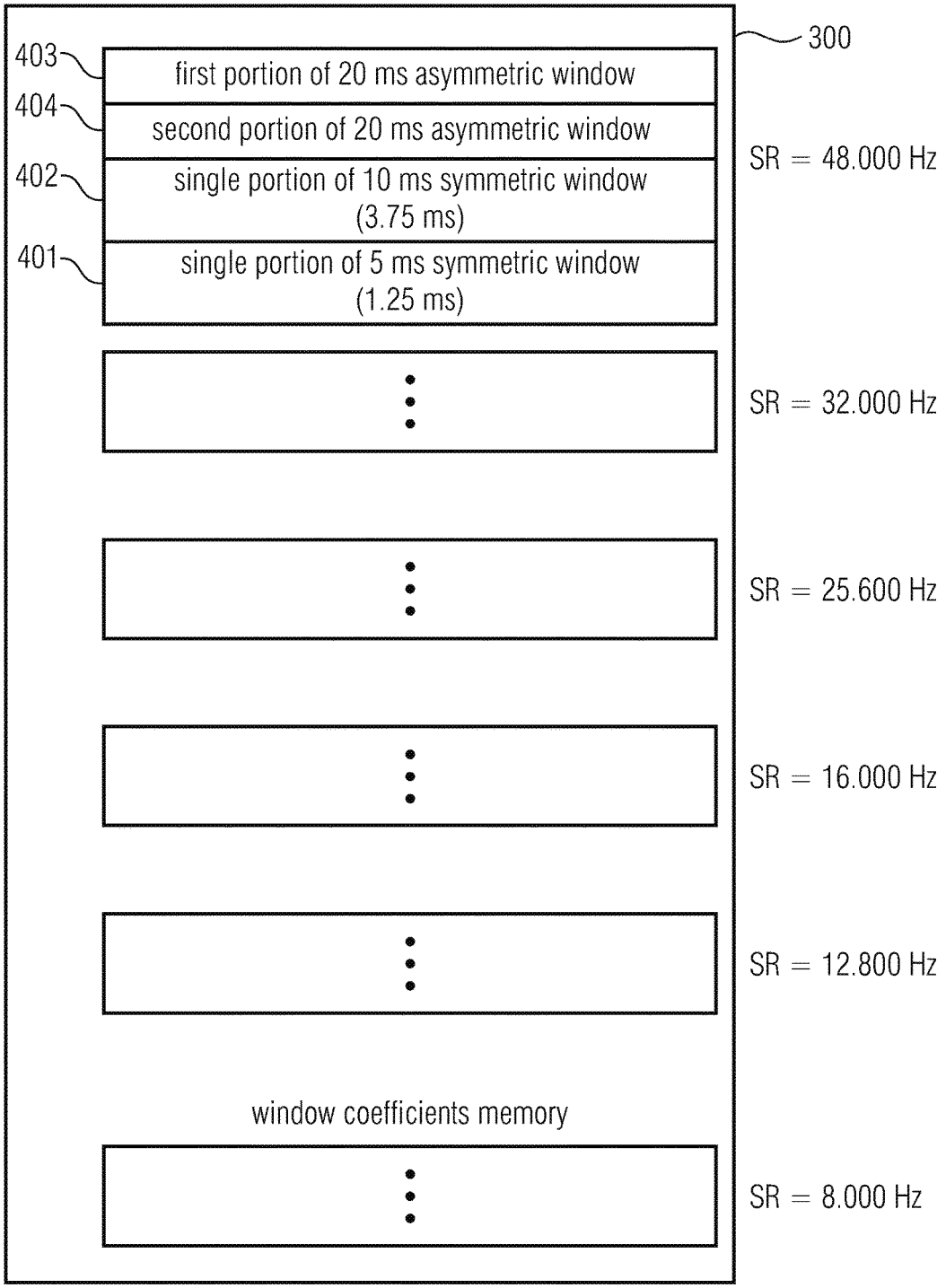
FIG. 4 illustrates a schematic illustration of the memory content of FIG. 3.

Furthermore, as will be outlined specifically with respect to FIG. 4, the present embodiment uses six different sampling rates and the length of the window edges or window flanks are selected in such a way that the length corresponds to an integer number of sampling values for each of the sampling rates.

Furthermore, it is outlined that for 10 ms transforms, overlaps of 3.75 ms or overlaps of 1.25 ms are used. Hence, even more combinations than illustrated in the window figures from FIG. 8*a* to FIG. 15*b* are possible and useful and can be signaled by the window control signal in order to make sure that an optimum window sequence is selected for a certain audio signal having transient portions at specific portions.

FIG. 10*a* illustrates this transition window or second window following a longer first window. In FIG. 10*a*, the left side has been truncated to a length of 8.75 ms from the original length of the long edge of the asymmetric analysis window 800 which was 14.375 ms. Hence, FIG. 10*a* illustrates a first overlap portion 1000 derived by a truncation from the first overlap portion 800 of the first asymmetric window. Furthermore, the FIG. 10*a* analysis transition window additionally comprises a right overlap portion of 1.25 ms, i.e., a short overlap portion 1002. The window is for a block size of 5 ms corresponding to a window length of 10 ms. Folding lines are indicated at 4.375 ms, i.e., 1004 and 9.375 ms illustrated at 1006. Furthermore, the fold-in portions 1008 for the left folding line 1004 and 1010 for the right folding line 1006 are illustrated.

FIG. 10*b* illustrates an implementation of an embodiment where a fade-in is used. Hence, the first overlap portion has a different first portion 1012 and an unmodified second portion 1014 which both correspond to the first overlap portion 1000 of FIG. 10*a*. The window is not different with respect to FIG. 10*a*. Advantageously, in order to calculate the first portion of the first overlap portion indicated at 1012 in FIG. 10*b* a 1.25 ms sine overlap portion is used, i.e., the portion, for example, indicated at 922 in FIG. 9*b*. Thus, a very good fade-in characteristic is obtained in which the first overlap portion 922 for the short window is, in a sense, "recycled". Thus, this window portion is not just used for windowing as in the case of FIG. 9*b* but, additionally, for an actual calculation of the analysis transition window in order to reduce artifacts incurred by the truncation. Although the perfect reconstruction property is only obtained when the actually truncated first overlap portion 1000 of FIG. 10*a* is used, it has been found that the audio quality can nevertheless be increased by using the transition window in FIG. 10*b* which has the fade-in portion. This fade-in portion although violating the perfect reconstruction property nevertheless results in a better audio quality compared to the FIG. 10*a* embodiment due to the fact that the discontinuity at the left-hand side of the left overlap portion 1000 in FIG. 10*a* is eliminated. Nevertheless, other fade-in or (with respect to the synthesis side) fade-out characteristics different from a sine function can be used if available and useful.

FIG. 10*c* illustrates a representation of the FIG. 10*a* window but now in an overlapping situation indicating the right overlap portion 1020 of the preceding window and the left overlap portion of the subsequent window at 1022. Typically, the right overlap portion 1020 is the right portion 802 of the asymmetric analysis window of FIGS. 8*a* and 1022 of the next or subsequent window is the first overlap portion of a window or is the left overlap portion of a further transition window as the case may be.

FIG. 10*d* illustrates a similar situation as FIG. 10*b* but again with the second overlap portion 1020 of the preceding window and the first overlap portion 1022 of the following window indicated.

Figure 11A:
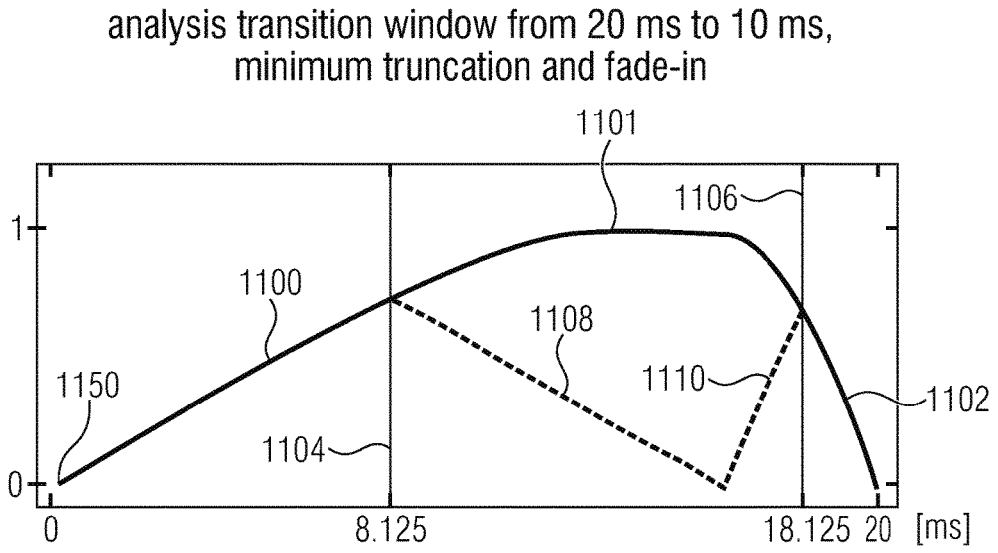
FIG. 11*a* illustrates a different transition window with a fade-in for the analysis-side.

FIG. 11*a* illustrates a further analysis transition window but, in contrast to FIG. 10*a*, where a transition from a 20 ms block to a 5 ms block is indicated, for a transition from a 20 ms block to a 10 ms block. Generally, the 20 ms block can be considered as a long block, the 5 ms block can be considered as a short block and the 10 ms block can be considered as an intermediate block. The first overlap portion 1100 has been truncated but only a short amount and the truncation is indicated by 1150. However, in order to further improve the audio quality a fade-in obtained by multiplying a 1.25 ms sine edge is already applied and the fade-in is indicated by the solid line. Furthermore, the window has a high part 1101 and a second overlapping portion 1102 which is, in this case, a long overlap portion with 3.75 ms. Hence, FIG. 11*a* illustrates an optimum analysis transition window corresponding to the "second window" of FIG. 2 from a transform length of 20 ms to a transform length of 10 ms where the left overlap portion 1100 is obtained by a truncation as small as possible of the long edge 800 of the asymmetric window and where, additionally, a fade-in is performed by multiplying the truncated edge 1050 by the 1.25 ms sine edge. As outlined, the right overlap is 3.75 ms.

Figure 11B:
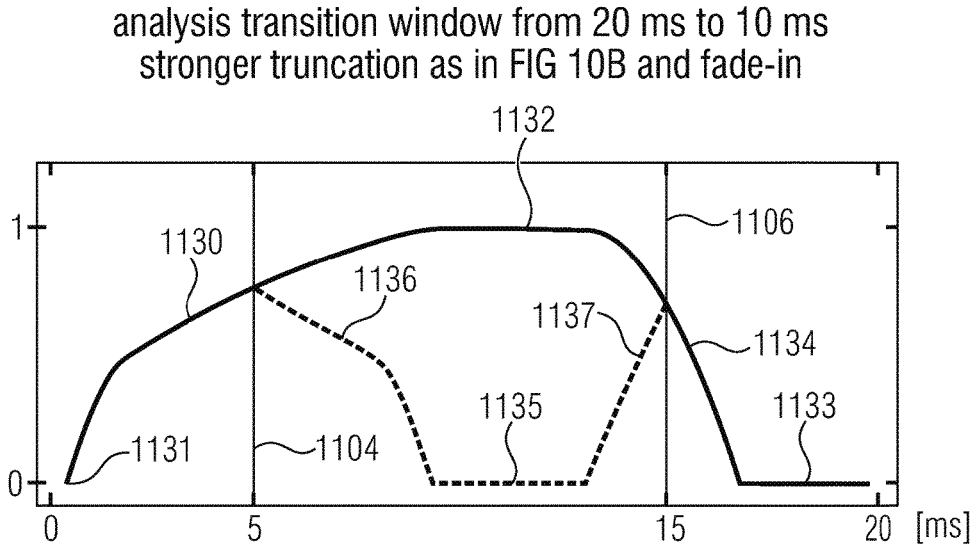
FIG. 11*b* illustrates a further analysis transition window with a higher than necessitated truncation and a corresponding further modification.

FIG. 11*b* illustrates an alternative analysis transition window for a transition from a 20 ms transform length to a 10 ms transform length, i.e., generally from a long transform length to the short transform length. The left overlap, however, is only 8.75 ms by truncating the left edge of the asymmetric window and by additionally performing a fading-in by multiplying using the 1.25 ms sine edge. Hence, the overlap or the left overlap portion 1130 now has 8.75 ms as in the case of FIG. 10*a*. In order to apply this window, further modifications are performed. These modifications are the first low or zero part 1131, the second high or constant part 1132 and the third or low part 1133 and the second overlap portion 1134 is similar as the corresponding portion 1102 in FIG. 11*a* but shifted to the left due to the fourth zero or low part 1133. Furthermore, folding lines 1104, 1106 are indicated and folded-in portions where marker 1135 indicates the border between the left folded-in portion 1136 and the right folded-in portion 1137. The lengths of the portions 1131, 1132, 1133 are determined by the fact that the truncation is performed more than the minimum possible as in FIG. 11*a*. Exemplarily, portion 1131 could be set to zero and the length of 1132 and 1133 could be correspondingly increased. On the other hand, the length of 1133 could be set of zero and, therefore, the length of 1131 could be correspondingly increased or all portions 1131, 1132, 1133 are different from zero but the corresponding lengths are different from the FIG. 11*b* embodiment. In all these different window implementations, it is to be made sure that the folding via the folding lines 1104, 1106 is correspondingly possible and b has the advantage with respect to FIG. 11*a* that the calculation of the first overlap portion 1130 is similar to the calculation of the left portion 1014, 1012 of FIG. 10*b* eases the practical implementation. However, when these issues are not as prominent then one might use the FIG. 11*a* window since the longer overlap of the first overlap portion performs a better reconstruction characteristic and is even more close to the perfect reconstruction property law.

Figure 12A:
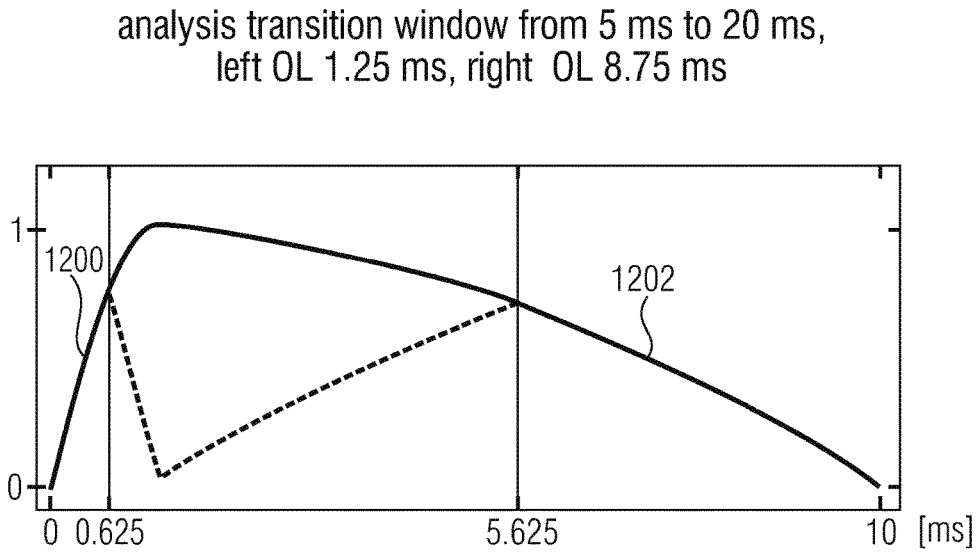
FIG. 12*a*,12*b* illustrate analysis transition windows for a transition from a small to a high block size.
Figure 12B:
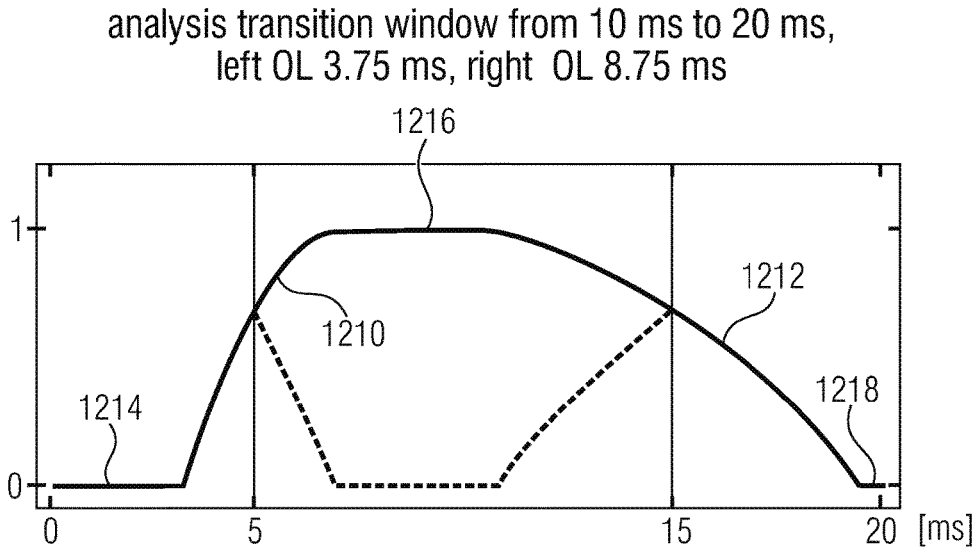

FIGS. 12*a* and 12*b* illustrate further analysis transition windows from shorter window lengths to higher window lengths. One such analysis transition window is illustrated in FIG. 12*a* for a transition from 5 ms to 20 ms. The left overlap portion 1200 is for a short overlap of, for example, 1.25 ms and the right overlap portion is for a long overlap such as 8.75 ms and is illustrated at 1202. FIG. 12*b* illustrates a further analysis transition window from a 10 ms block to a 20 ms block. The left overlap portion is indicated at 1210 and the right overlap portion is indicated at 1212. The left overlap portion is for the medium overlap of 3.75 ms and the right overlap portion is for a long or a high overlap of 8.75 ms. Again, the folding lines and folded-in portions are illustrated. FIG. 12*b* makes clear that the analysis transition window from 10 to 20 ms has, in addition to the overlap portions 1210, 1212, a left low or zero part 1214, a medium high or constant part 1216 and a right low or zero part 1218.

The right overlap portion 1202 of FIG. 12*a* and the right overlap portion 1212 in FIG. 12*b* corresponds to the short edge of the asymmetric analysis window indicated at 802 in FIG. 8*a*.

Figure 13A:
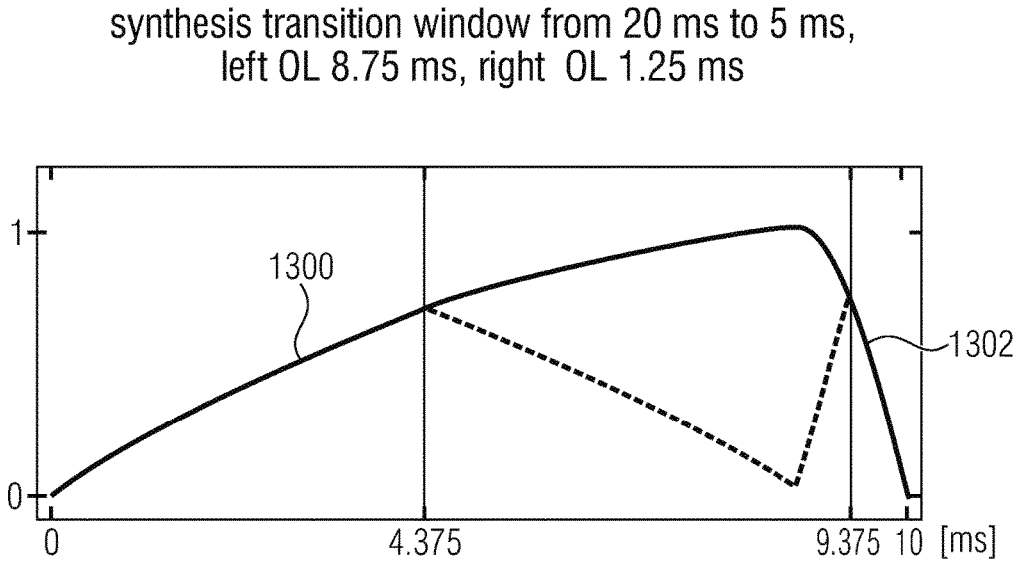
FIG. 13*a*,13*b* illustrate synthesis transition windows from a high block size to a low block size.
Figure 13B:
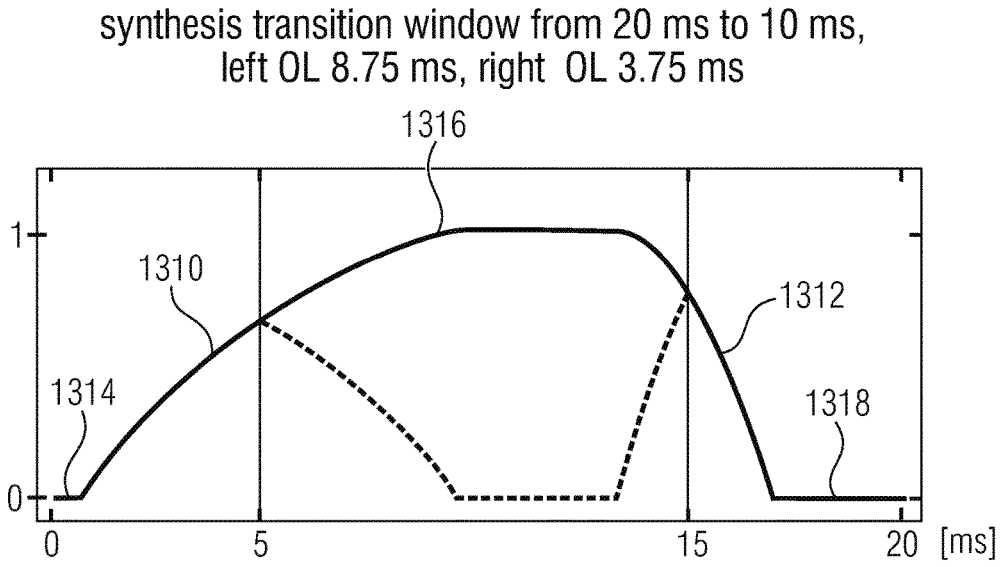
Figure 13C:
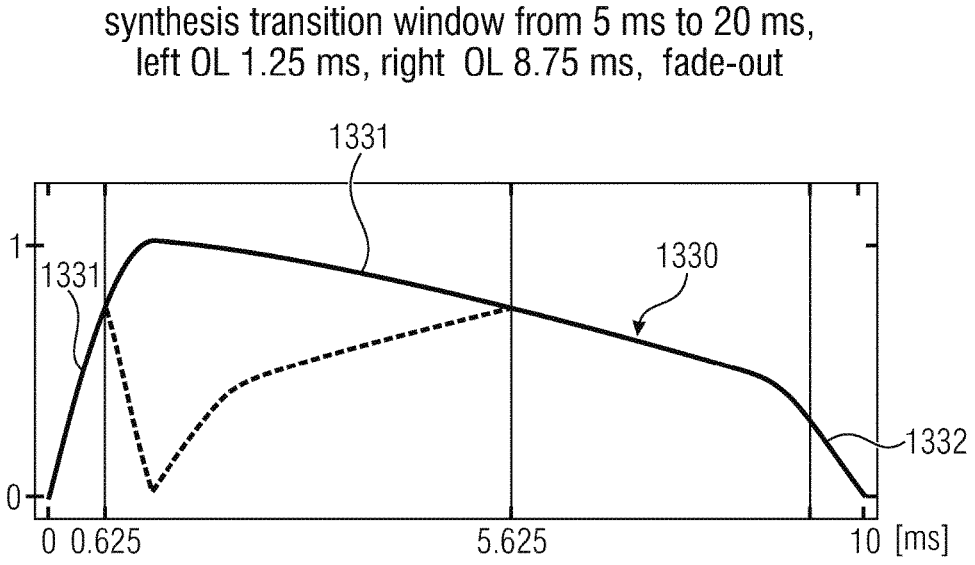
FIG. 13*c* illustrates a synthesis transition window with a truncated second overlap portion such as the third window.
Figure 13D:
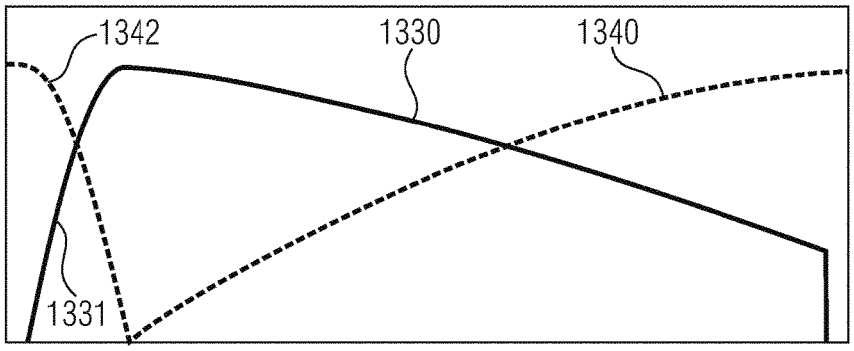
FIG. 13*d* illustrates the window of FIG. 13*c*, but without the fade-out.

FIGS. 13*a*, 13*b*, 13*c* and 13*d* illustrate a situation on the synthesis-side, i.e., illustrate the construction of a third window in the terms of FIG. 2 or Case B. Furthermore, the situation in FIG. 13*a* is analogous to the situation in FIG. 12*a*. The situation in FIG. 13*b* is analogous to the situation in FIG. 12*b*. The situation in FIG. 13*c* is analogous to FIG. 10*b* and the situation in FIG. 13*d* is analogous to FIG. 10*c*.

In particular, FIG. 13*a* illustrates a synthesis transition window from a long block to a short block having a left long overlap portion 1300 and a right overlap portion 1302 and corresponding folding lines and folding portions as indicated.

FIG. 13*b* illustrates a synthesis transition window from a 20 ms block to a 10 ms block where the left overlap is once again a long overlap indicated at 1310 and the right overlap is 1312 and, additionally, a first low part 1314, a second high part 1316 and a third low part 1318 is provided as necessitated.

FIG. 13*c* illustrates a third synthesis window as illustrated in the context of FIG. 2, Case B, where the second overlap portion 1330 is indicated. It has been truncated to a length of 8.75, i.e., to the length of the right or second overlap portion of the asymmetric synthesis window of FIG. 8*b*, i.e., the right overlap portion 814 has been truncated to obtain the right overlap portion 1330 of the synthesis transition window and, in the situation of FIG. 13*c*, a further fade-out has been performed basically similar to what has been discussed on the analysis-side with respect to FIG. 10*b*. This illustrates the situation of the second overlap portion 1330 of the third window in the terms of FIG. 2, Case B, but only with truncation rather than any fade-out. Thus, the first portion 1331 in FIG. 13*c* is similar to the corresponding first portion of FIG. 13*d* but the second portion 1332 is different due to the fade-out multiplying a descending 1.25 ms sine edge by the truncated window of FIG. 13*d*.

Furthermore, FIG. 13*d* illustrates the first overlap portion 1340 of the next synthesis window corresponding to the "fourth window" in the context of FIG. 2 and, furthermore, FIG. 13*d* illustrates the second overlap portion 1342 of the preceding window, i.e., the window before the third window consisting of the second overlap portion 1330 and a first overlap portion 1331 corresponding to a short overlap of 1.25 ms for example.

Although not illustrated, a synthesis window corresponding to the situation in FIGS. 11*a*, 11*b* is useful, i.e., a synthesis window having a minimum truncation with or without fade-in in analogy to FIG. 11*a* or a synthesis window having the same kind of truncation as in FIG. 13*d* but now with first and second zero or low parts and an intermediate constant part.

Figure 14A:
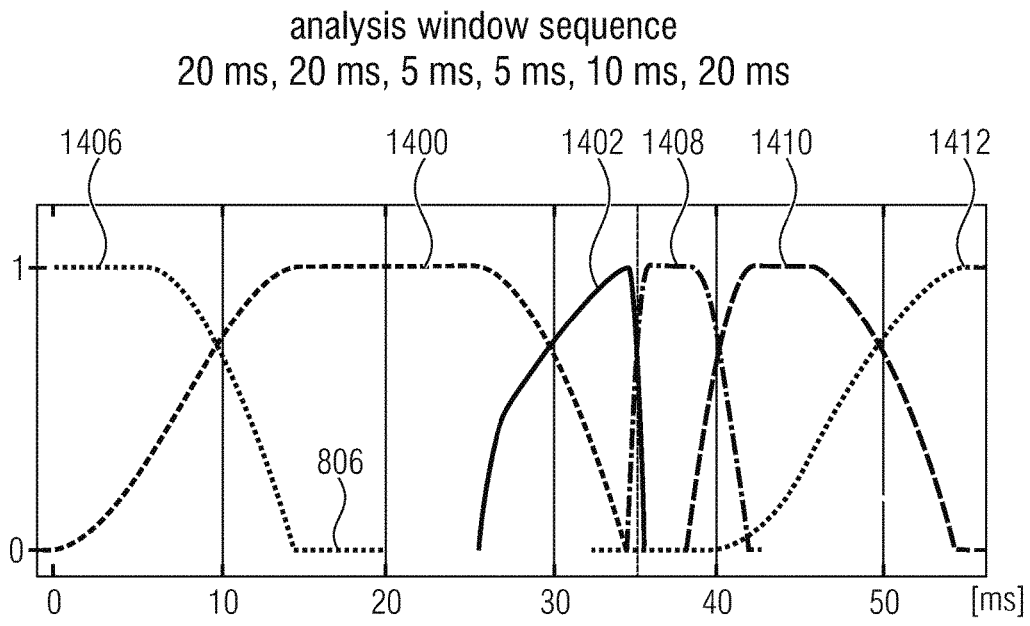
FIG. 14*a* illustrates a certain analysis window sequence.
Figure 14B:
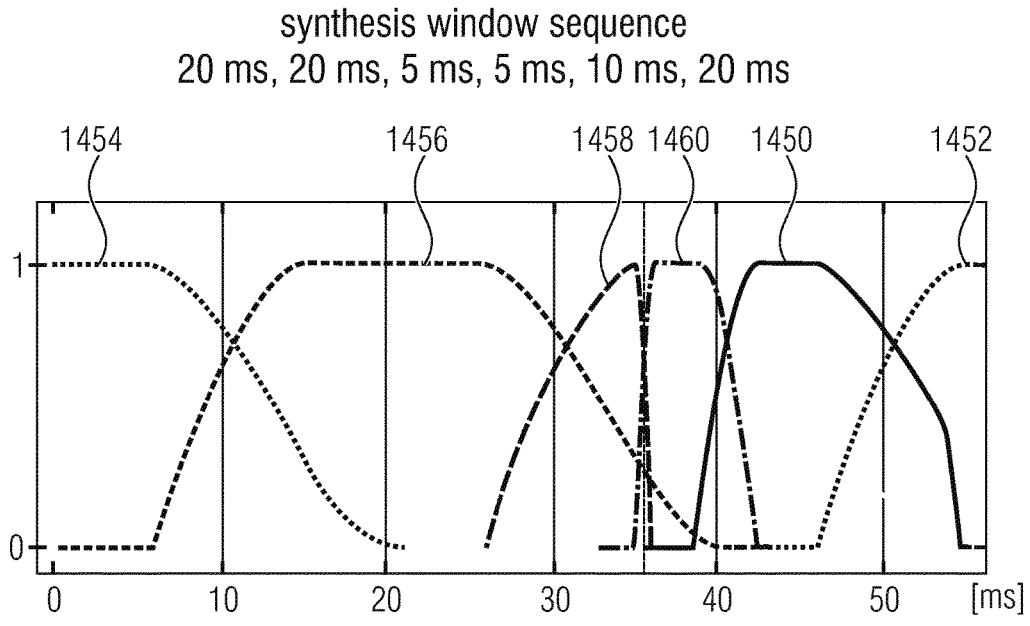
FIG. 14*b* illustrates a corresponding synthesis window sequence.

FIG. 14*a* illustrates an analysis window sequence with windows with block sizes of long, long, short, short, intermediate, long and the corresponding synthesis window sequences illustrated in FIG. 14*b*. The second window in the terms of FIG. 2 is indicated at 1402 and this window corresponds to the window illustrated in FIG. 10*b*. Correspondingly, the matching synthesis window corresponding to the third window function 1450 of FIG. 14*b* in the terms of FIG. 2 is the synthesis function not illustrated in the specific figure but to the analysis function of FIG. 11*b*.

Figure 15A:
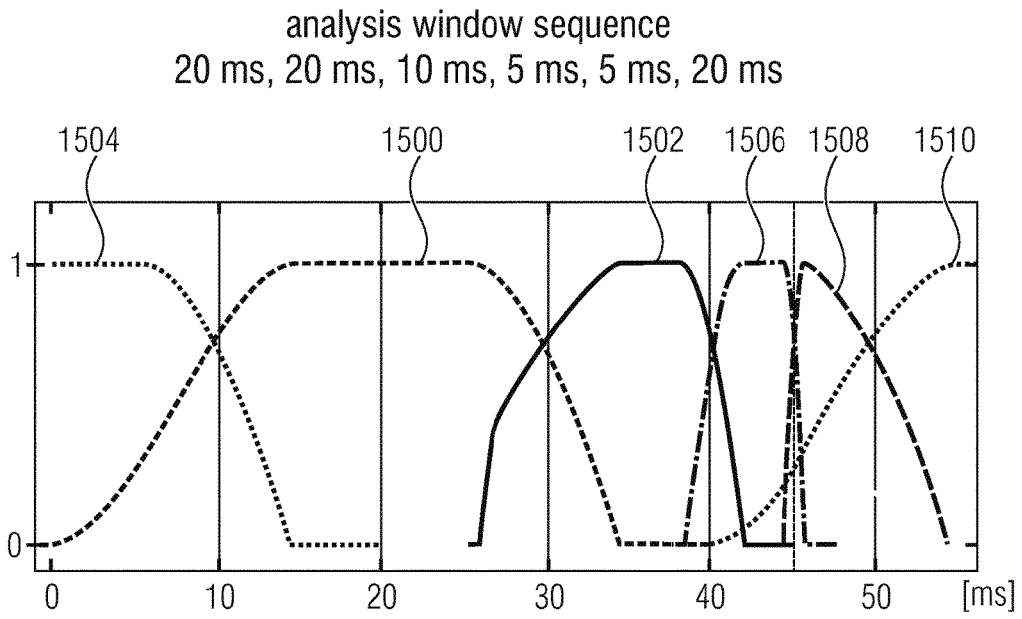
FIG. 15*a* illustrates a certain analysis window sequence.
Figure 15B:
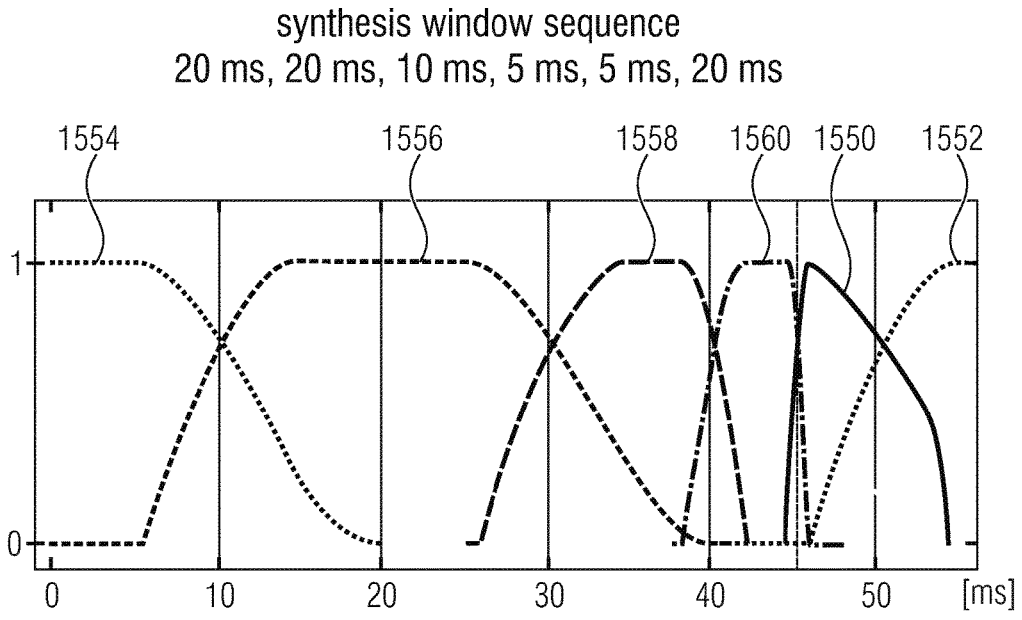
FIG. 15*b* illustrates a corresponding synthesis window sequence matched to FIG. 15*a*.
Figure 16:
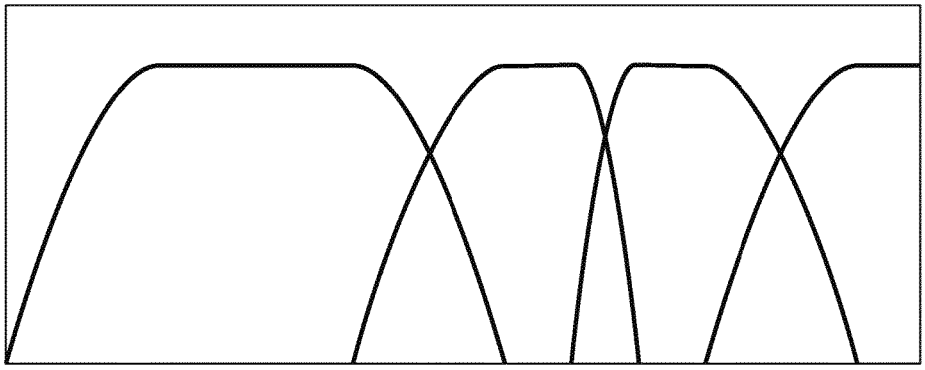
FIG. 16 illustrates an example for instant switching between different transform lengths using symmetric overlaps only.

Furthermore, in FIG. 15*a*, the 1502 is specifically illustrated in FIG. 11*b* and the third window function 1550 of FIG. 15*b* corresponds to the synthesis window function of FIG. 13*c*.

Hence, FIG. 14*a* illustrates a transition from a very first long asymmetric window with 20 ms indicated at 1406 to the first asymmetric window function 1400 where, specifically, the zero portion 806 of FIG. 8*a* is also illustrated. In FIG. 14*a* then follows the long asymmetric window 1400 and, subsequently, the second window function with the truncated first overlap portion 1402 is illustrated. The following window 1408 is similar to the window in FIG. 9*b* and the following window 1410 corresponds to the FIG. 9*c* window and, finally, window 1412 is once again the asymmetric analysis window of FIG. 8*a*.

FIG. 14*b* illustrates a long synthesis window 1454 corresponding to FIG. 8*b* and further asymmetric synthesis window 1456 again corresponding to FIG. 8*b* and then a short transition window 1458 is illustrated, which corresponds to FIG. 13*a*. The following window 1460 is also a short window having a block size of 5 ms corresponds to FIG. 9*c*.

FIGS. 15*a* and 15*b* illustrate a similar window sequence, but with a transition from a long window to an intermediate window having a length of 10 ms and the corresponding opposite transition. Windows 1504 and 1500 correspond to FIG. 8*a*. The inventive truncated and faded-in window 1502 follows which is followed by window 1506, 1508 and 1510 in the illustrated order. The window 1506 corresponds to the window in FIG. 9*b* but with the long overlap to the left-hand side and the short overlap to the right-hand side. Window 1508 corresponds to the window in FIG. 12*a* and window 1510 is once again the long asymmetric window.

Regarding the synthesis window sequence in FIG. 15*b*, there are windows 1554, 1556, 1558 and 1560. 1554 corresponds to the synthesis window of FIG. 8*b* and the same is true for window 1556. Window 1558 is a transition from 20 to 10 and corresponds to FIG. 13*b*. Window 1560 is a transition from 10 to 5 and corresponds to FIG. 9*b* but, once again, with the long overlap to the left-hand side overlapped to the right-hand side. The inventively truncated and fade-out window 1550 follows which is again followed by the long asymmetric synthesis window.

Subsequently, an implementation of the window constructor 206 is discussed in the context of FIG. 3. In particular, the window constructor may comprise a memory 300, a window portion truncator 302 and a fader 304. Depending on the window control information illustrated at item 310 indicating a transition, for example, from the first window to the second window or from the third window to the fourth window, the window portion truncator 302 is activated. The truncator accesses the memory in order to retrieve the portion 800 of the asymmetric window or to retrieve the second overlap portion 814 of the fourth window. The portion is retrieved by retrieval line 308 from the memory 300 to the window portion truncator. The window portion truncator 302 performs a truncation to a certain length such as the maximum truncation length as discussed or shorter than the maximum length. The truncated overlap portion or window edge 316 is then forwarded to the fader 304. The fader then performs a fading-in or fading-out operation, i.e., the operation to arrive at the window in FIG. 10*b*, for example from the window in FIG. 10*c* illustrating the truncated window without fade-in. To this end, the fader accesses the memory via the access line 314 from the memory of the short overlap portion via retrieval line 312. The fader 304 then performs the fading-in or fading-out operation with the truncated window portion from line 316, for example by multiplying the truncated portion with the overlap portion. The output is the truncated and faded portion at output line 318.

FIG. 4 illustrates an implementation of the memory 300, the window construction by the window constructor and the different shapes and possibilities of the windows are optimized to have a minimum memory usage. An embodiment of the present invention allows the usage of six sampling rates of 48 kHz, 32 kHz, 25.6 kHz, 16 kHz, 12.8 kHz or 8 kHz. For each sampling rate a set of window coefficients or window portions is stored. This is a first portion of the 20 ms asymmetric window, the second portion of the 20 ms asymmetric window, a single portion of the 10 ms symmetric window such as the 3.75 ms overlap portion and the single portion of the 5 ms symmetric window such as the 1.25 ms overlap portion. Typically, the single portion of the 10 ms symmetric window may be the ascending edge of the window and then, by straightforward arithmetic or logic operation such as mirroring, the descending portion can be calculated. Alternatively, when the descending portion is stored in the memory 300 as the single portion then the ascending portion can be calculated by mirroring or, generally, by arithmetic or logic operations. The same is true for the single portion of the 5 ms symmetric window. Naturally, due to the fact that all windows having lengths of 5 or 190 ms can have on each side either the medium overlap portion such as 3.75 ms or the short overlap portion having e.g. a length of 1.25 ms.

Furthermore, the window constructor is configured to determine, on its own in accordance with corresponding predefined rules, the length and position of the low or zero portions and the high or one-portions of the specific windows as illustrated in the plots from FIGS. 8*a* to 15*b*.

Thus, only a minimum amount of memory requirements are necessitated for the purpose of implementing an encoder and a decoder. Hence, apart from the fact that encoder and decoder rely on one and the same memory 300, even a waste amount of different windows and transition windows etc., can be implemented only by storing four sets of window coefficients for each sampling rate.

The transform window switching outlined above was implemented in an audio coding system using asymmetric windows for long transforms and low-overlap sine windows for short transforms. The block length is 20 ms for long blocks and 10 ms or 5 ms for short blocks. The left overlap of the asymmetric analysis window has a length of 14.375 ms, the right overlap length is 8.75 ms. The short windows use overlaps of 3.75 ms and 1.25 ms. For the transition from 20 ms to 10 ms or 5 ms transform length on encoder side the left overlapping part of the asymmetric analysis window is truncated to 8.75 ms and used for the left window part of the first short transform. A 1.25 ms sine-shaped fade-in is applied by multiplying the left end of the truncated window with the 1.25 ms ascending short window overlap. Reusing the 1.25 ms overlap window shape for the fade-in avoids the need for an additional ROM/RAM table, as well as the complexity for on-the-fly computation of the fade-in shape. FIG. 14*a* depicts the resulting window sequence for an example with transform length sequence 20 ms, 5 ms, 5 ms, 10 ms, 20 ms.

On decoder side for the transition from 10 ms or 5 ms to 20 ms transform length the right overlapping part of the asymmetric synthesis window is truncated to 8.75 ms and used for the right window part of the last short transform. A 1.25 ms sine-shaped fade-out similar to the fade in on encoder side is applied to the truncated end of the window. The decoder window sequence for the example above is depicted in FIG. 14*b*.

Figure 5:
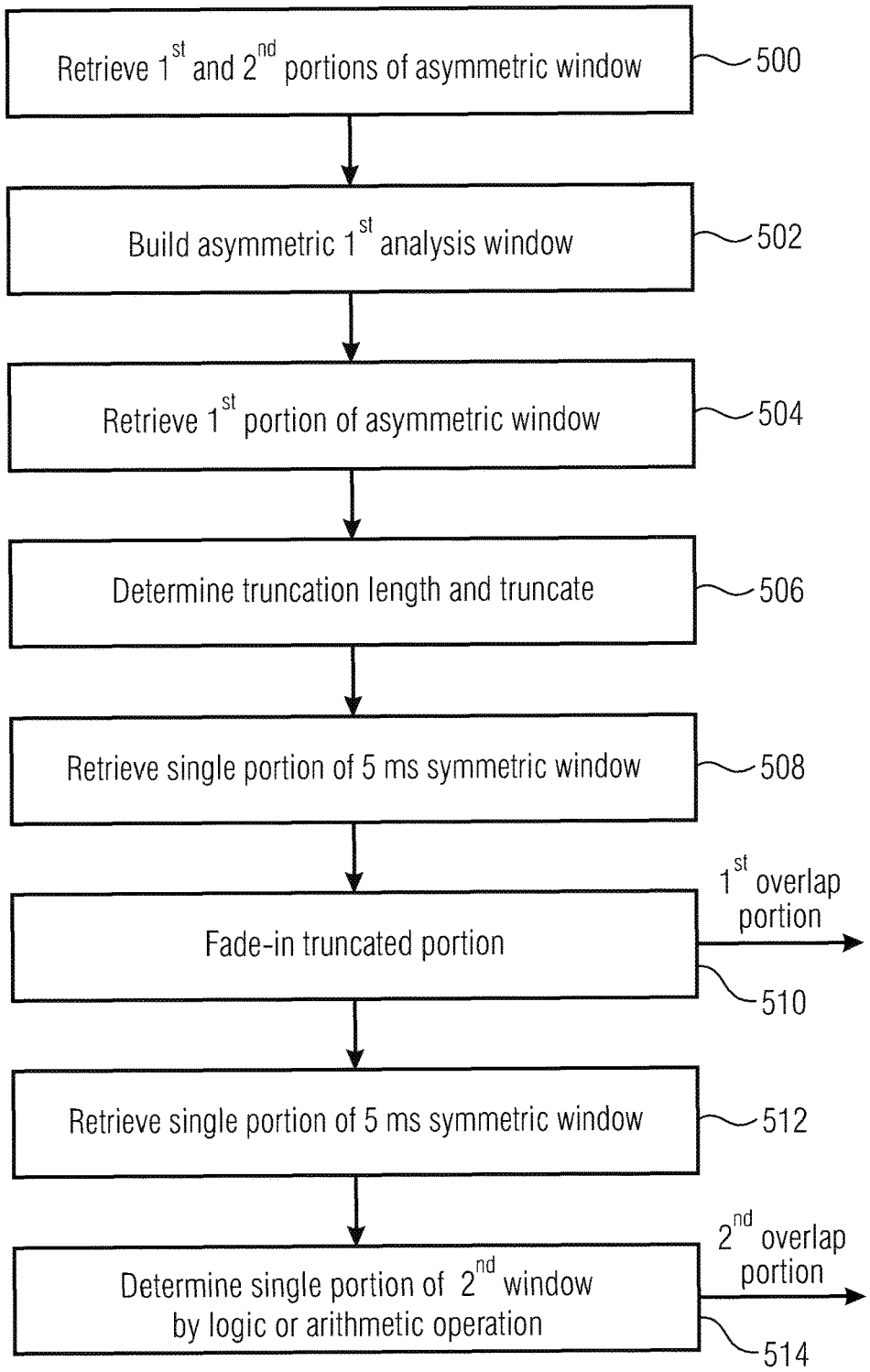
FIG. 5 illustrates a procedure for determining the first overlap portion and the second overlap portion of an analysis transition window.

FIG. 5 illustrates the flow chart of a further embodiment for determining the second window, i.e., an analysis transition window for Case A of FIG. 2. In step 500, the first and second portions of the asymmetric window are retrieved. In step 502, the asymmetric first analysis window is built. Thus, the analysis window 1400 of FIG. 14B or 1500 of FIG. 15A is generated.

Figure 3:
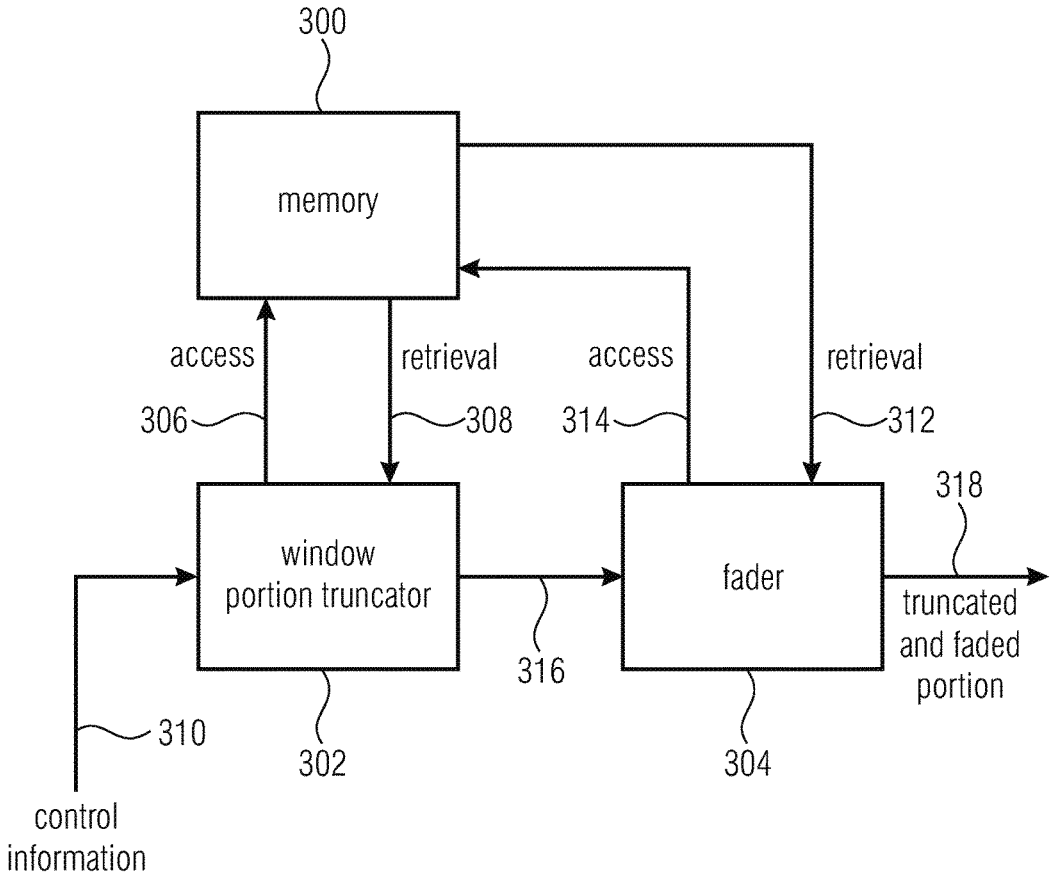
FIG. 3 illustrates an implementation of the window constructor.

In step 504, the first portion of the asymmetric window is retrieved by a retrieval line, for example illustrated in FIG. 3 at 308. In step 506, the truncation length is determined and the truncation is performed such as by the window portion truncator 302 in FIG. 3. In step 508, a single portion of the 5 ms symmetric window is retrieved such as Item 401 stored in the memory 300. In step 510, the fade-in of the truncated portion is calculated, for example by the operation of the fader 304 in FIG. 3. Now, the first overlap portion is completed. In step 512, the single portion of the 5 ms symmetric window is retrieved, for example, for a transition from a long window to a short window or the single portion of a 10 ms symmetric window is retrieved for a transition from a long to an intermediate window. Finally, the second portion is determined by logic or arithmetic operations from the data retrieved in step 512 is indicated by step 514. Note, however, that step 514 is not required when the single portion of the corresponding symmetric window retrieved by step 512 from the memory 300 in FIG. 4 already can be used as the second portion, i.e., as the descending window edge.

Although not illustrated explicitly in FIG. 5, a further step is necessitated for the purpose of other transitions such as the transition illustrated in FIG. 15*a*. Here, the first zero part, the second zero part and the intermediate high part have to be additionally inserted by the window constructor, while this insertion can be done before or subsequent to the determination of the first and second overlap portions of the second window.

Figure 6:
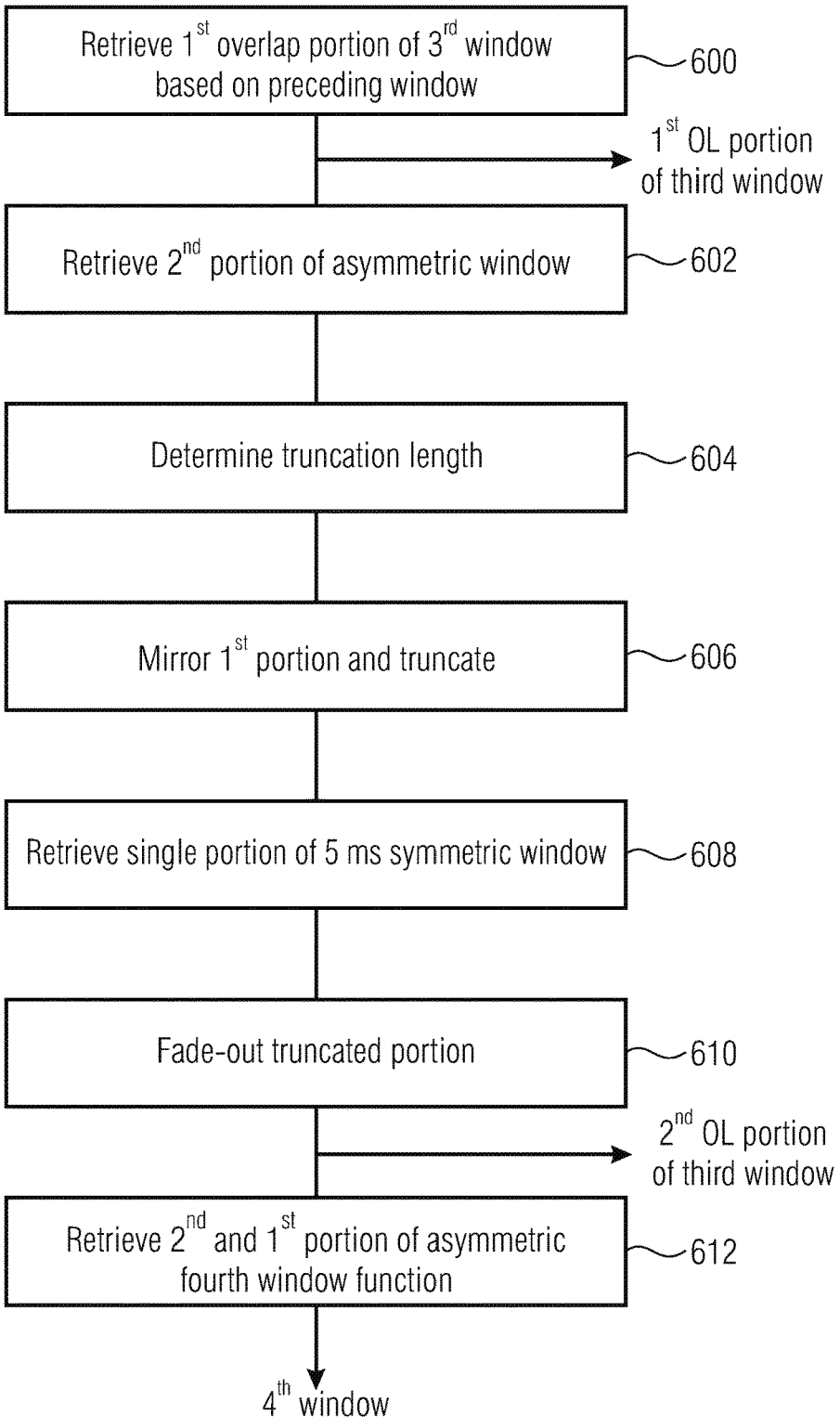
FIG. 6 illustrates a procedure for determining a synthesis transition window.

FIG. 6 illustrates an implementation of the procedure for constructing a corresponding synthesis transition window such as the third window. To this end, the procedure of steps in FIG. 6*a* can be performed. In step 600, a first overlap portion of the third window is retrieved from the memory or, if not specifically available in this form, calculated by arithmetic or logic operations from the data in the memory and this is done based on the preceding window since the first overlap portion of the synthesis window is already fixed by the overlap of the preceding window. The second portion of the asymmetric window, i.e., the long portion of the asymmetric synthesis window is retrieved and in step 604, a truncation length is determined. In step 606, this first portion is, if necessitated, mirrored and then the truncation is performed using the determined truncation length. In step 608, the single portion of the 5 ms overlap portion of the symmetric window is retrieved and, subsequently to step 608, the fade-out of the truncated portion is performed, as illustrated in step 610. The second overlap portion of the third window is completed and, subsequently, the second and fourth portions of the asymmetric fourth window function are retrieved and applied to finally obtain the fourth window as indicated by step 612.

Figure 7:
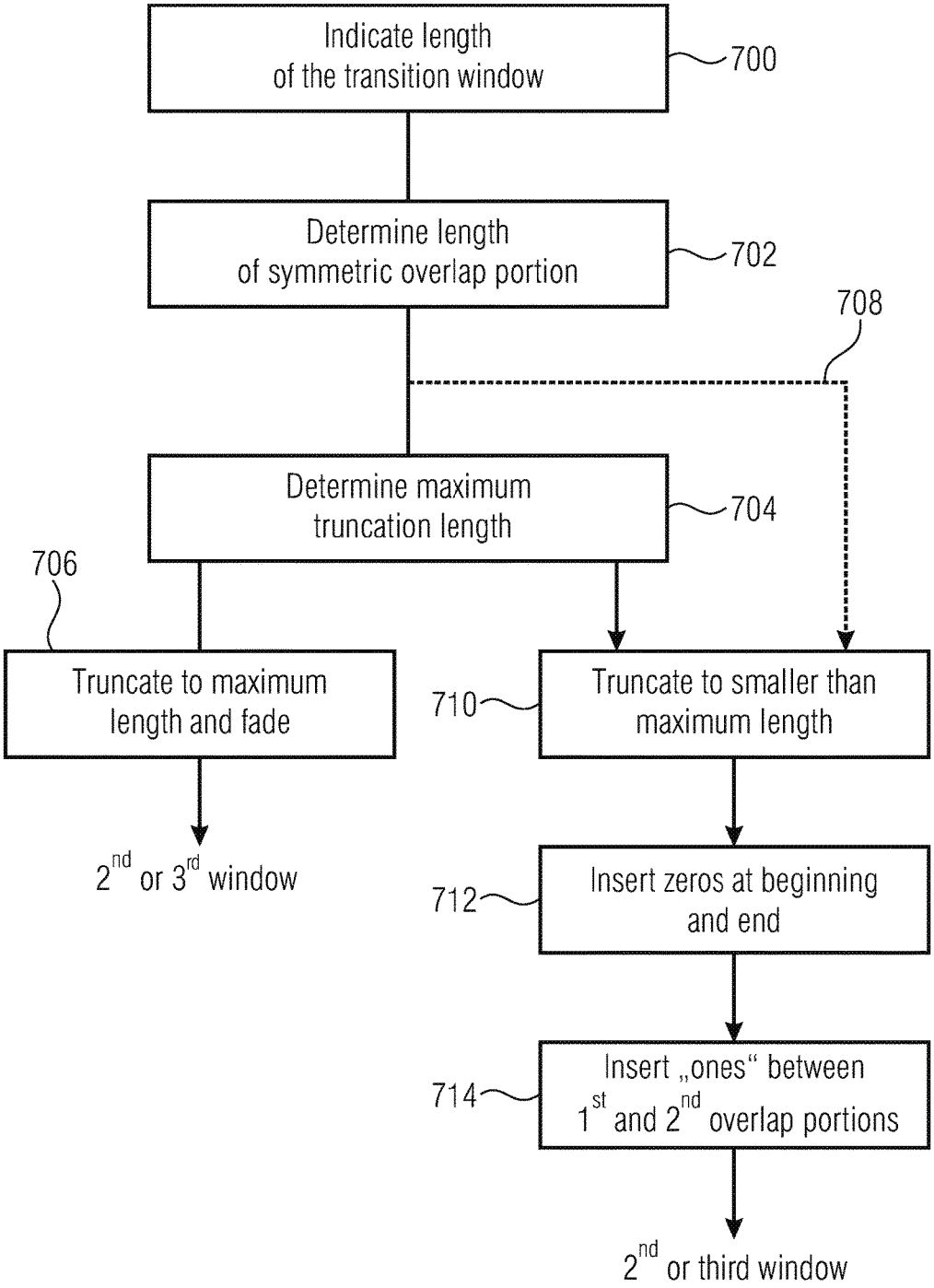
FIG. 7 illustrates a further procedure with a truncation smaller than the maximum length.

FIG. 7 illustrates a procedure for determining the truncation length. As outlined before with respect to FIGS. 10*b* and 11 *b*, different truncation lengths can be performed. There can be a truncation to the maximum truncation length, i.e., the situation in FIG. 11*a* or a truncation to a length smaller than the maximum truncation length as illustrated in FIG. 11*b* for the same situation. To this end, the procedure in FIG. 7 starts with an indication of the length of the transition window illustrated at step 700. Step 700, therefore, provides the information whether the transition window is for a block size of 10 ms, i.e., with a length of 20 ms or is shorter, i.e., a window for a length of 10 ms for a block size of 5 ms.

Then, in step 702 the length of the symmetric overlap portion of the window is determined. For the analysis side this means that the length of the second overlap portion is determined while, for the synthesis side, this means that the length for the first overlap portion is determined. The step 702 makes sure that the "fixed" situation of the transition window is acknowledged, i.e., that the transition window has a symmetric overlap. Now, in step 704, the second edge of the window or the other overlap portion of the window is determined. Basically, the maximum truncation length is the difference between the length of the transition window and the length of the symmetric overlap portion. When this length is greater than the length of the long edge of the asymmetric window then no truncation is necessary at all. However, when this difference is smaller than the long edge of the asymmetric window then a truncation is performed. The maximum truncation length, i.e., the length by which a minimum truncation is obtained is equal to this difference. Where necessitated a truncation to this maximum length, i.e., a minimum truncation, can be performed and a certain fade can be applied as illustrated in FIG. 11*a* or 10*b*. As illustrated in FIG. 11*a*, a certain number of ones are necessitated in order to make sure that the folding along the folding lines 1104, 1106 is possible due to the fact that these folding lines should not be changed in certain embodiments. Hence, a certain number of ones as indicated at 1101 in FIG. 11*a* are necessitated for the 20 to 10 ms analysis transition window but these ones are not necessary for the 20 to 5 ms transition window of FIG. 10*b*.

Step 704, however, can be bypassed as illustrated by 708. A truncation to a smaller than a maximum length is then performed in step 710 leading to the situation of FIG. 11*b*. The remaining window portion has to be filled with zeros and ones and, in particular, has to be accounted for by inserting zeros at the beginning and an end of the window indicated at portions 1131 and 1133 in step 712. Furthermore, an insertion of a corresponding number of ones to obtain the high portion 1132 has to be performed as indicated at 714 in order to make sure that the folding-in around the folding points 1104 and 1106 properly operates as illustrates in FIG. 11*b*.

Hence, the number of zeros of portion 1131 is equal to a number of zeros immediately close to the first overlap portion 1130, a number of zeros in portion 1133 of FIG. 11*b* corresponds to a number of zeros immediately adjacent to the second overlap portion 1134 of FIG. 11*b*. Then the folding in with the marker 1135 around the folding lines 1104 and 1106 properly works.

Although the embodiments have been described with window length of 40 ms and transform length of 20 ms as a long window, a block size of 10 ms for intermediate windows and a block size of 5 ms for a short window, it is to be emphasized that a different block or window size can be applied. Furthermore, it is to be emphasized that the present invention also is useful for only two different block sizes but three different block sizes are of advantage in order to have a very good placement of short window functions with respect to a transient as, for example, discussed in detail in PCT/EP2014/053287 additionally discussing multi-overlap portions, i.e., an overlap between more than two windows occurring in the sequences in FIGS. 15*a* and 15*b* or 14*a* and 14*b*.

Although the present invention has been described in the context of block diagrams where the blocks represent actual or logical hardware components, the present invention can also be implemented by a computer-implemented method. In the latter case, the blocks represent corresponding method steps where these steps stand for the functionalities performed by corresponding logical or physical hardware blocks.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

The inventive transmitted or encoded signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disc, a DVD, a Blu-Ray, a CD, a ROM, a PROM, and EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may, for example, be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive method is, therefore, a data carrier (or a non-transitory storage medium such as a digital storage medium, or a computer-readable medium) comprising, recorded thereon, the computer program for performing one of the methods described herein. The data carrier, the digital storage medium or the recorded medium are typically tangible and/or non-transitory.

A further embodiment of the invention method is, therefore, a data stream or a sequence of signals representing the computer program for performing one of the methods described herein. The data stream or the sequence of signals may, for example, be configured to be transferred via a data communication connection, for example, via the internet.

A further embodiment comprises a processing means, for example, a computer or a programmable logic device, configured to, or adapted to, perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example, a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCES

[1] International Organization for Standardization, ISO/IEC 14496-3, "Information Technology—Coding of audio-visual objects—Part 3: Audio," Geneva, Switzerland, August 2009.

[2] Internet Engineering Task Force (IETF), RFC 6716, "Definition of the Opus Audio Codec," September 2012.

[3] C. R. Helmrich, G. Markovic and B. Edler, "Improved Low-Delay MDCT-Based Coding of Both Stationary and Transient Audio Signals," in *Proceedings of the IEEE* 2014 *Int. Conference on Acoustics, Speech and Signal Processing* (*ICASSP*), 2014 or PCT/EP2014/053287.

The invention claimed is:

1. An audio processor for processing an audio signal to obtain a processed audio signal, comprising:

an analyzer configured for deriving a window control signal from the audio signal indicating a change from a first asymmetric window comprising a first overlap portion to a second window comprising a first overlap portion or indicating a change from a third window comprising a second overlap portion to a fourth asymmetric window comprising a second overlap portion, wherein the second window is shorter than the first window, or wherein the third window is shorter than the fourth window;

a window constructor configured for constructing the second window using the first overlap portion of the first asymmetric window, wherein the window constructor is configured to determine the first overlap portion of the second window using a truncated first overlap portion of the first asymmetric window, or configured for constructing the third window using the second overlap portion of the fourth asymmetric window, wherein the window constructor is configured to calculate the second overlap portion of the third window using a truncated second overlap portion of the fourth asymmetric window; and a windower configured for applying the first and second windows or the third and fourth windows to acquire windowed audio signal portions representing the processed audio signal, wherein one or more of the analyzer, the window constructor and the windower is implemented, at least in part, by one or more hardware elements of the audio processor.

2. The audio processor of claim 1, wherein the first and second windows are analysis windows or the third and fourth windows are synthesis windows, wherein the audio processor further comprises an audio encoder configured for further processing samples windowed by the first and second windows, or wherein the audio processor further comprises an overlap-adder configured for overlap-adding samples windowed by the third and fourth windows.

3. The audio processor of claim 1, wherein the window constructor is configured to derive the first overlap portion of the second window by truncating the first overlap portion of the first window and by fading-in the truncated portion, or wherein the window constructor is configured to derive the second overlap portion of the third window by truncating the second overlap portion of the fourth window and by fading-out the truncated portion.

4. The audio processor of claim 3, wherein the window constructor is configured for performing the fade-in or the fade-out using a sine fade-in function or a sine fade-out function.

5. The audio processor of claim 3, wherein the window constructor is configured to calculate the fade-in or fade-out using an overlap portion of any other window used by the processor.

6. The audio processor of claim 5, wherein the window constructor is configured to calculate the fade-in or fade-out using a shortest overlap portion of all overlap portions used.

7. The audio processor of claim 1, further comprising a memory having stored thereon, for a certain sampling rate, the first overlap portion of the first asymmetric window, a second overlap portion of the first asymmetric window and a third overlap portion for a further window shorter than the first window, wherein the window constructor is configured for retrieving the first overlap portion of the first asymmetric window from the memory, for truncating the first overlap portion to a length shorter than the length of the first overlap portion, for retrieving the third overlap portion, and for multiplying the truncated first portion by the third overlap portion to generate the first overlap portion of the second window; or wherein the window constructor is configured for retrieving the second overlap portion of the fourth asymmetric window from the memory, for truncating the second overlap portion retrieved to a length shorter than the length of the second overlap portion, for retrieving the third overlap portion; and for multiplying the truncated second overlap portion by the third overlap portion to generate the second overlap portion of the third window.

8. The audio processor of claim 7, wherein the memory has furthermore stored a fourth overlap portion of an even further window, the even further window comprising a length between a length of the first window and a length of the further window.

9. The audio processor of claim 8, wherein the window constructor is configured to construct, depending on the window control signal, a sequence comprising the first window, the second window, an additional window constructed using the third overlap portion and the fourth overlap portion or using the third overlap portion only, and a further additional window using the third overlap portion and the second overlap portion of the first window.

10. The audio processor of claim 1, wherein the window constructor is configured to determine the first overlap portion of the second window using the truncated first overlap portion of the first asymmetric window being truncated to a length of a second overlap portion of the first asymmetric window, or to determine the second overlap portion of the third window using a second overlap portion of the fourth window truncated to a length of the first overlap portion of the fourth asymmetric window.

11. The audio processor of claim 1, wherein the window constructor is configured to determine the second window using the first overlap portion of the second window and a second overlap portion of the second window corresponding to a first overlap portion of a further window following the second window, or wherein the window constructor is configured to construct the third window by using a first overlap portion of the third window corresponding to a second overlap portion of a further window preceding the third window.

12. The audio processor of claim 1, wherein the window constructor is configured to truncate the first overlap portion of the first asymmetric window or the second overlap portion of the fourth asymmetric window to a truncation length being shorter or equal than a window length of the second or third window less a length of the first overlap portion of a further window following the second window or a length of a second overlap portion of a further window preceding the third window.

13. The audio processor of claim 12, wherein, when the truncation length is smaller than the window length less the length of the first overlap portion of the further window or the second overlap portion of the window, the window constructor is configured to insert zeroes before or subsequent to the first and second overlap portions of the second or third window, and wherein the window constructor is furthermore configured to insert a number of "1" values between the first and second overlap portions of the second window or the third window.

14. The audio processor of claim 1, wherein the first asymmetric window comprises a first overlap portion, a second overlap portion, a first high value part between the first and second overlap portion and a second low value part subsequent to the second overlap portion, wherein the values in the high value part are greater than 0.9 and the values in the low value part are lower than 0.1, and wherein the length of the second overlap portion is lower than a length of the first overlap portion.

15. The audio processor of claim 1, which is configured to operate at a plurality of different sampling rates, and wherein the processor is configured to store, for each sampling rate, the first and second overlap portions of the first or fourth window, a symmetric overlap portion of a further window, and a further symmetric overlap portion of an even further window being shorter than the further window; and wherein the symmetric overlap portion and the further symmetric overlap portion are stored as an ascending or a descending portion only, and wherein the window constructor is configured to derive a descending or an ascending portion from the stored ascending or descending portion by arithmetic or logic operations.

16. The audio processor of claim 1, wherein the first window is configured for a transform length of 20 ms, wherein the window constructor is configured for further using further windows for transform length of 10 ms or 5 ms, and wherein the second window is a transition window from the transform length of 20 ms to the transform length of 10 ms or 5 ms, or wherein the fourth window is configured for the transform length of 20 ms, and wherein the third window is a transition window from the transform length of 5 ms to 20 ms or from the transform length of 10 ms to 20 ms.

17. A method of processing an audio signal to obtain a processed audio signal, comprising:

deriving a window control signal from the audio signal indicating a change from a first asymmetric window comprising a first overlap portion to a second window comprising a first overlap portion or indicating a change from a third window comprising a second overlap portion to a fourth asymmetric window comprising a second overlap portion, wherein the second window is shorter than the first window, or wherein the third window is shorter than the fourth window;

constructing the second window using the first overlap portion of the first asymmetric window, wherein the constructing comprises determining the first overlap portion of the second window using a truncated first overlap portion of the first asymmetric window, or constructing the third window using the second overlap portion of the fourth asymmetric window, wherein the constructing comprises calculating the second overlap portion of the third window using a truncated second overlap portion of the fourth asymmetric window; and applying the first and second windows or the third and fourth windows to acquire windowed audio signal portions representing the processed audio signal, wherein one or more of the deriving, the constructing, and the applying is implemented, at least in part, by one or more hardware elements of an audio signal processing device.

18. A non-transitory digital storage medium having stored thereon a computer program for performing, when running on a computer, a method of processing an audio signal to obtain a processed audio signal, the method comprising:

deriving a window control signal from the audio signal indicating a change from a first asymmetric window comprising a first overlap portion to a second window comprising a first overlap portion or indicating a change from a third window comprising a second overlap portion to a fourth asymmetric window comprising a second overlap portion, wherein the second window is shorter than the first window, or wherein the third window is shorter than the fourth window;

constructing the second window using the first overlap portion of the first asymmetric window, wherein the constructing comprises determining a first overlap portion of the second window using a truncated first overlap portion of the first asymmetric window, or constructing the third window using the second overlap portion of the fourth asymmetric window, wherein the constructing comprises calculating the second overlap portion of the third window using a truncated second overlap portion of the fourth asymmetric window; and applying the first and second windows or the third and fourth windows to acquire windowed audio signal portions representing the processed audio signal.

* * * * *